US008260713B2

(12) United States Patent
Holcombe

(10) Patent No.: US 8,260,713 B2
(45) Date of Patent: Sep. 4, 2012

(54) WEB-BASED SYSTEM PROVIDING ROYALTY PROCESSING AND REPORTING SERVICES

(75) Inventor: Scott Alan Holcombe, San Diego, CA (US)

(73) Assignee: RoyaltyShare, Inc., San Diego, CA (US)

( * ) Notice: Subject to any disclaimer, the term of this patent is extended or adjusted under 35 U.S.C. 154(b) by 737 days.

(21) Appl. No.: 11/671,220

(22) Filed: Feb. 5, 2007

(65) Prior Publication Data

US 2008/0071561 A1 Mar. 20, 2008

Related U.S. Application Data

(60) Provisional application No. 60/767,569, filed on Aug. 23, 2006.

(51) Int. Cl.
*G06Q 99/00* (2006.01)

(52) U.S. Cl. ..... 705/59; 705/50; 705/52; 705/53; 705/1.1

(58) Field of Classification Search ..... 705/50–79
See application file for complete search history.

(56) References Cited

U.S. PATENT DOCUMENTS

| | | | | |
|---|---|---|---|---|
| 5,511,190 | A * | 4/1996 | Sharma et al. | 707/1 |
| 5,671,412 | A | 9/1997 | Christiano | |
| 5,897,637 | A * | 4/1999 | Guha | 707/101 |
| 6,189,146 | B1 | 2/2001 | Misra et al. | |
| 6,289,341 | B1 | 9/2001 | Barney | |
| 6,385,596 | B1 * | 5/2002 | Wiser et al. | 705/51 |
| 6,633,651 | B1 * | 10/2003 | Hirzalla et al. | 382/100 |
| 6,636,867 | B2 | 10/2003 | Robertson | |
| 6,772,196 | B1 * | 8/2004 | Kirsch et al. | 709/206 |
| 6,868,403 | B1 * | 3/2005 | Wiser et al. | 705/51 |
| 6,968,337 | B2 * | 11/2005 | Wold | 707/100 |
| 2003/0135369 | A1 * | 7/2003 | Stoimenov et al. | 704/235 |
| 2003/0204698 | A1 * | 10/2003 | Sachedina et al. | 711/170 |
| 2004/0093262 | A1 * | 5/2004 | Weston et al. | 705/10 |
| 2004/0221295 | A1 * | 11/2004 | Kawai et al. | 719/313 |
| 2005/0138176 | A1 * | 6/2005 | Singh et al. | 709/226 |
| 2007/0064598 | A1 * | 3/2007 | Nooner et al. | 370/229 |
| 2008/0301058 | A1 | 12/2008 | Campbell | |

OTHER PUBLICATIONS

White, "How Computers Work", Millennium Edition, 1999, Que Corporation, Indianapolis, IN, all pages.*
Derfler, "How Networks Work", Bestseller Edition, 1996, Ziff-Davis Press, Emeryville, CA, all pages.*
Gralla, "How the Internet Works", Millennium Edition, 1999, Que Corporation, Indianapolis, IN, all pages.*
Muller, "Desktop Encyclopedia of the Internet", 1999, Artech House Inc., Norwood, MA, all pages.*

* cited by examiner

*Primary Examiner* — Jacob C. Coppola
(74) *Attorney, Agent, or Firm* — John A. Smart

(57) ABSTRACT

A computer-implemented system providing Web-based royalty processing and reporting is described. In one embodiment, for example, a computer-implemented method of the present invention for automatic identification of media items subject to royalty obligations, includes steps of: receiving sales input from a user comprising media items subject to royalty obligations; parsing the sales input to extract for each media item a set of fields characterizing that media item; deriving a plurality of signatures for each media item, based on different combinations of the fields for that media item; comparing the derived signatures for each media item against a database storing signatures of known media items; based on the comparison, automatically identifying media items present in the sales input; and reporting the automatically identified media items to the user.

52 Claims, 35 Drawing Sheets

Log out

RoyaltyShare

Sales | Royalties | Catalog | Users | Contact

[submenu]

FIG. 2

Email Address [ ]

Password [ ]

[Log In]

Forgot Password?

FIG. 3

Good job! You are now logged in.

Choose a label to work with [Select a Label… ▾]

[Go]

You can skip this step in the future by entering the label URL directly (e.g. labelname.royaltyshare.com)

FIG. 4

Welcome back, <first name>

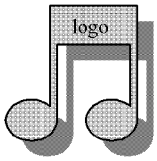

Quick Links
Royalty Status Tracker
User Administration

Viewing: All Labels

Digital Sales Dashboard

<< Previous Q2 2005 (current)

Top

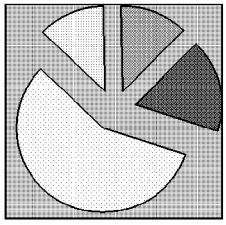

Thing That Ipsum Factum

Top Formats

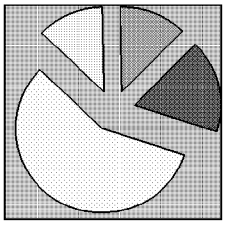

Thing That Ipsum Factum

Top Albums

| | | |
|---|---|---|
| Something | 384 | $8,232 |
| Another | 255 | $6,419 |
| Love it | 206 | $5,938 |
| One More | 194 | $3,802 |

Top Tracks

| | | |
|---|---|---|
| Something | 384 | $8,232 |
| Another | 255 | $6,419 |
| Love it | 206 | $5,938 |
| One More | 194 | $3,802 |

Services Reported

| | Apr | May | Jun |
|---|---|---|---|
| **iTunes** | ✓ | ✓ | ✓ |
| **MusicMatch** | ✓ | ✓ | ✓ |
| **eMusic** | | ✓✓✓ | |

*FIG. 5*

Viewing: All Labels

Revenue By Service

<< Previous Q2 2005 (current)

Top Albums

| | Units | Total Rev | iTunes | Napster Rhapsody |
|---|---|---|---|---|
| Something $9,999.99 | 999 | $9,999.99 | $9,999.99 | $9,999.99 |
| Another $9,999.99 | 999 | $9,999.99 | $9,999.99 | $9,999.99 |

Top Tracks

| | Units | Total Rev | iTunes | Napster Rhapsody |
|---|---|---|---|---|
| Something $9,999.99 | 999 | $9,999.99 | $9,999.99 | $9,999.99 |
| Another $9,999.99 | 999 | $9,999.99 | $9,999.99 | $9,999.99 |

Viewing: All Labels

Revenue By Format

<< Previous Q2 2005 (current)

Thing
That
Ipsum
Factum

Top Albums

| | Units | Revenue | Download | Stream | Ringtone |
|---|---|---|---|---|---|
| Something | 999 | $9,999.99 | $9,999.99 | $9,999.99 | $9,999.99 |
| Another | 999 | $9,999.99 | $9,999.99 | $9,999.99 | $9,999.99 |

Top Tracks

| | Units | Revenue | Download | Stream | Ringtone |
|---|---|---|---|---|---|
| Something | 999 | $9,999.99 | $9,999.99 | $9,999.99 | $9,999.99 |
| Another | 999 | $9,999.99 | $9,999.99 | $9,999.99 | $9,999.99 |

Viewing: All Labels
Top Albums
<< Previous Q2 2005 (current)
| | Units | Revenue | iTunes | Napster | Rhapsody |
|---|---|---|---|---|---|
| Something | 999 | $9,999.99 | $9,999.99 | $9,999.99 | $9,999.99 |
| Another | 999 | $9,999.99 | $9,999.99 | $9,999.99 | $9,999.99 |
| Love it | 999 | $9,999.99 | $9,999.99 | $9,999.99 | $9,999.99 |
| One M | 999 | $9,999.99 | $9,999.99 | $9,999.99 | $9,999.99 |
| The Last | 999 | $9,999.99 | $9,999.99 | $9,999.99 | $9,999.99 |
| Something | 999 | $9,999.99 | $9,999.99 | $9,999.99 | $9,999.99 |
| Another | 999 | $9,999.99 | $9,999.99 | $9,999.99 | $9,999.99 |
| Love it | 999 | $9,999.99 | $9,999.99 | $9,999.99 | $9,999.99 |
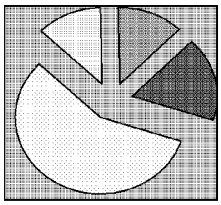
Thing That Ipsum Factum
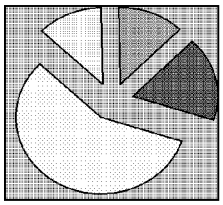
Thing That Ipsum Factum
FIG. 8

Viewing: All Labels
Top Tracks
<< Previous Q2 2005 (current)
| | Units | Revenue | iTunes | Napster |
|---|---|---|---|---|
| **Rhapsody** | | | | |
| Something | 999 | $9,999.99 | $9,999.99 | $9,999.99 |
| $9,999.99 | | | | |
| Another | 999 | $9,999.99 | $9,999.99 | $9,999.99 |
| $9,999.99 | | | | |
| Love it | 999 | $9,999.99 | $9,999.99 | $9,999.99 |
| $9,999.99 | | | | |
| One M | 999 | $9,999.99 | $9,999.99 | $9,999.99 |
| $9,999.99 | | | | |
| The Last | 999 | $9,999.99 | $9,999.99 | $9,999.99 |
| $9,999.99 | | | | |
| Something | 999 | $9,999.99 | $9,999.99 | $9,999.99 |
| $9,999.99 | | | | |
| Another | 999 | $9,999.99 | $9,999.99 | $9,999.99 |
| $9,999.99 | | | | |
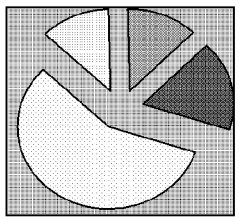
Thing That Ipsum Factum
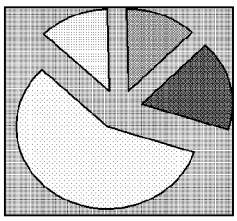
Thing That Ipsum Factum
FIG. 9

Viewing: All Labels

<service> Revenue

<< Previous Q2 2005 (current)

Formats

Top Albums

| | Units | Revenue | Download | Stream | Ringtone |
|---|---|---|---|---|---|
| Something $9,999.99 | 999 | $9,999.99 | $9,999.99 | $9,999.99 | |
| Another $9,999.99 | 999 | $9,999.99 | $9,999.99 | $9,999.99 | |

Top Tracks

| | Units | Revenue | Download | Stream | Ringtone |
|---|---|---|---|---|---|
| Something $9,999.99 | 999 | $9,999.99 | $9,999.99 | $9,999.99 | |
| Another $9,999.99 | 999 | $9,999.99 | $9,999.99 | $9,999.99 | |

Viewing: All Labels

<format> Revenue

<< Previous Q2 2005 (current)

Services

Top Albums

| | Units | Revenue | Download | Stream | Ringtone |
|---|---|---|---|---|---|
| Something | 999 | $9,999.99 | $9,999.99 | $9,999.99 | $9,999.99 |
| Another | 999 | $9,999.99 | $9,999.99 | $9,999.99 | $9,999.99 |

Top Tracks

| | Units | Revenue | Download | Stream | Ringtone |
|---|---|---|---|---|---|
| Something | 999 | $9,999.99 | $9,999.99 | $9,999.99 | $9,999.99 |
| Another | 999 | $9,999.99 | $9,999.99 | $9,999.99 | $9,999.99 |

<< Prev
Next >>

Current Period – Apr 22, 2005-Present

| Service | Filename | Received | Units | Revenue | Lines | Exceptions Initial | Exceptions Left | Processed |
|---|---|---|---|---|---|---|---|---|
| iTunes | itunes0305.xls | 04/28/2005 | 2431 | $1,212.23 | 814 | 24 | 8 | Pending |
| MSN | 042005.txt | 05/02/2005 | 744 | $638.50 | 342 | 17 | 0 | 05/08/2005 |
| Napster | nap0405.xls | 05/04/2005 | 1346 | $0 | 412 | 43 | 0 | Pending |

[Close Current Period]

Upload Sales File

Filename [ ] [Browse…]

[Upload]

Download Royalty Data

Choose format [Excel ▼]

[Download]

FIG. 14A

Are you sure you want to close the current period?

There are <num> files that still need to be processed.

[Yes] [No]

FIG. 14B

<filename> Service: <name> Lines: <num> Exceptions: <num>

| Type | Label | Date | Title | Album | Artist | UPC | ISRC | Vendor ID | Units | Total | Return |
|---|---|---|---|---|---|---|---|---|---|---|---|
| Album | xxxxxx | mm/yy | xxxxx | xxxxx | xxxxx | nnnnn | xxxxx | xxxxxx | nnn | nn.nn | N |

[Skip] [Previous]

FIG. 15A

Suggested Album Matches

| Choose | Catalog | UPC | Album | Artist |
|---|---|---|---|---|
| ○ | <catalog> | <upc> | <album name> | <artist name> |
| ○ | <catalog> | <upc> | <album name> | <artist name> |
| ○ | <catalog> | <upc> | <album name> | <artist name> |
| ⊙ | <catalog> | <upc> | <album name> | <artist name> |
| ○ | <catalog> | <upc> | <album name> | <artist name> |
| ○ | <catalog> | <upc> | <album name> | <artist name> |

[Match to Catalog]

FIG. 15B

Suggested Track Matches

| Choose | Catalog | UPC | ISRC | Album | Artist | (track) | Track |
|---|---|---|---|---|---|---|---|
| ○ | <catalog> | <upc> | <isrc> | <album> | <artist> | 6 | <track> |
| ○ | <catalog> | <upc> | <isrc> | <album> | <artist> | 2 | <track> |
| ○ | <catalog> | <upc> | <isrc> | <album> | <artist> | 1 | <track> |
| ⊙ | <catalog> | <upc> | <isrc> | <album> | <artist> | 2 | <track> |
| ○ | <catalog> | <upc> | <isrc> | <album> | <artist> | 3 | <track> |
| ○ | <catalog> | <upc> | <isrc> | <album> | <artist> | 4 | <track> |

[Match to Catalog]

FIG. 15C

Search Catalog [ ] [Go]

FIG. 15D

Filename: <filename>
Provider: <provider>
Reporting Month: <mm/yy>
Units: <999>

Streaming Revenue for <month> in USD: [ ]

[Update Revenue] [Cancel]

FIG. 16A $<99,999.99> entered, which is <0.999999> per stream. Update revenue with this amount?

[Update] [Cancel]

FIG. 16B

Filename: <filename>
Provider: <provider>
Received: <mm/dd/yy>
Units: <999>
Revenue: <$9,999.99>
Errors: <99>

[Finish Import]

FIG. 17A

<filename> imported and processed successfully!

Return to Status Tracker

FIG. 17B

Are you sure you want to split <filename>?

Splitting a file divides it into 2 separate files, one containing all the records with errors and the other containing the records without errors.

[Split] [Cancel]

FIG. 17C

<filename> split successfully!

<filename>-a.xls contains the clean sales records.
<filename>-b.xls contains the faulty sales records.

Return to Status Tracker

FIG. 17D

| Label | Email | Name | Location | Phone | Type | Disabled? | Login As |
|---|---|---|---|---|---|---|---|
| | scott@xyz.com | Scott Howle | San Diego, CA | 858.555.1111 | Admin | N | Login |
| Label A | bob@la.com | Bob Smith | Chicago, IL | 614.555.1211 | Label Adm | N | Login |
| Label B | tim@lb.com | Tim Davis | Stockton, CA | 311.555.6782 | Label User | N | Login |

<< Previous [Clear Search] Next >>

Search Users: [ ] [Go]

Add New User

FIG. 18

Email* [ ] Created <mm/dd/yy>
First Name* [ ] Modified <mm/dd/yy>
Last Name* [ ]

Address Line 1 [ ]
Address Line 2 [ ]
City [ ]
State [Choose… ▾]
Postal Code [ ]
Country [Choose… ▾]

Primary Phone* [ ] ext [ ]
Secondary Phone [ ] ext [ ]

Type* [Choose… ▾]
Label [Choose… ▾]
Primary Contact [Choose… ▾]
Emergency Contact [Choose… ▾]
Disabled? [Choose… ▾]

[Add user]

FIG. 19

During normal business hours (8am-5pm PT), please contact your account representative:

<firstname> <lastname>
<email>
<phone>

If you require assistance during non-business hours, please contact:

<firstname> <lastname>
<email>
<phone>

FIG. 20

```
1: // MusicNet.pm
2: // Copyright (c) 2006, RoyaltyShare, Inc. All Rights Reserved.
3: package Import::MusicNet;
4: use strict;
5: use Date::Calc qw(Days_in_Month);
6: use lib '/app/tools/common/lib';
7: use Common::Util;
8: use Common::Consts;
9: use lib '/app/tools/data_classes/lib';
10: use File::Sale;
11: my %field_map = (
12:             1 => {
13:                 'vendorid'  => 0,
14:                 'track'     => 1,
15:                 'upc'       => 2,
16:                 'album'     => 3,
17:                 'artist'    => 4,
18:                 'isrc'      => 5,
19:                 'units'     => 6,
20:                 'prodtype'  => 7,
21:                 'label'     => 8,
22:                 'tracknum'  => 9,
23:                 'clientid'  => 11,
24:                 'category'  => 13,
25:                 },
26:             2 => {
27:                 'vendorid'  => 0,
28:                 'track'     => 1,
29:                 'album'     => 3,
30:                 'artist'    => 4,
31:                 'upc'       => 5,
32:                 'isrc'      => 6,
33:                 'units'     => 7,
34:                 'prodtype'  => 8,
35:                 'label'     => 9,
36:                 'tracknum'  => 12,
37:                 },
38:             3 => {
39:                 'vendorid'  => 0,
40:                 'track'     => 1,
```

FIG. 23A

```
41:                     'album'     => 3,
42:                     'artist'    => 4,
43:                     'upc'       => 5,
44:                     'isrc'      => 6,
45:                     'units'     => 7,
46:                     'prodtype'  => 8,
47:                     'label'     => 9,
48:                     'tracknum'  => 13,
49:                     },
50:                 4 => {
51:                     'vendorid'  => 0,
52:                     'track'     => 1,
53:                     'album'     => 3,
54:                     'artist'    => 4,
55:                     'upc'       => 5,
56:                     'isrc'      => 6,
57:                     'units'     => 7,
58:                     'prodtype'  => 8,
59:                     'label'     => 9,
60:                     'tracknum'  => 13,
61:                     },
62:                 );
63: use lib '/app/tools/sale_import/lib';
64: use Import::Importer;
65: use base 'Import::Importer';
66: #public methods
67: sub _importLines
68: {
69:   my $self = shift;
70:   my %args = @_;
71:   my $retval = undef;
72:   my $lines = $args{lines};
73:   my $fileObj = $args{file};
74:   my $fileName = $fileObj->OrigFileName;
75:     ##my $fileName = $args{OrigFileName}; # for cmd-line testing
76:     my $version = $fileObj->VersionNum;
77:     ##my $version = $args{version}; # for cmd-line testing
78:     return undef unless ($lines && $fileName && $version);
79:     my $offsets = $field_map{$version};
80:     ## category only applies to version 1, so everything using it
81:     ## will only be applied if category field is present in file
```

FIG. 23B

```
82:     my $loggableCategory = '^(NORMAL|TRIAL)$';
83:     my ($countryCode, $dateBegin, $dateEnd);
84:     if ($version == 1) {
85:         ($countryCode, $dateBegin, $dateEnd) = $fileName =~
m/^(GB)?.*(20\d\d-\d\d-01)_(20\d\d-\d\d-\d\d)/;
86:     } else {
87:         my ($m1, $d1, $y1, $m2, $d2, $y2) = $fileName =~
m/(\d\d)(\d\d)(\d{4})_(\d\d)(\d\d)(\d{4})/;
88:         $dateBegin = "${y1}-${m1}-${d1}";
89:         $dateEnd   = "${y2}-${m2}-${d2}";
90:     }
91:   unless ($dateBegin && $dateEnd) {
92:         $self->errstr("couldn't get dates");
93:         print STDERR "filename: $fileName\n";
94:         return undef;
95:     }
96:   my $currencyCode;
97:   my $conversionRate;
98:   if ($countryCode eq "GB")
99:   {
100:     $currencyCode = "GBP";
101:     $conversionRate = 0;
102:   }
103:   else
104:   {
105:     $countryCode = "US";
106:     $currencyCode = "USD";
107:     $conversionRate = 1.0;
108:   }
109:   my $linenum = 1;
110:   foreach my $line(@$lines)
111:   {
112:     if ($linenum == 1) {
113:           $linenum++;
114:           next;
115:         }
116:     my $prodtype;
117:     my $format;
118:     if ($line->[$offsets->{'prodtype'}] =~ m/^Streams$/i &&
119:           ## only check if category present in this version
120:           (!(defined $offsets->{'category'}) ||
$line->[$offsets->{'category'}] =~ m/$loggableCategory/i))
121:     {
122:       $prodtype  = File::Sale::TYPE_TRACK;
123:       $format    = File::Sale::FORMAT_STREAM;
124:     }
```

FIG. 23C

```
125:    if ($line->[$offsets->{'prodtype'}] =~ m/^Play ?Counts$/i &&
126:            ## only check if category present in this version
127:            (!(defined $offsets->{'category'}) ||
$line->[$offsets->{'category'}] =~ m/$loggableCategory/i))
128:    {
129:      $prodtype  = File::Sale::TYPE_TRACK;
130:      $format    = File::Sale::FORMAT_TETHERED;
131:    }
132:    if ($line->[$offsets->{'prodtype'}] =~ m/^Device Play Counts$/i &&
133:            ## only check if category present in this version
134:            (!(defined $offsets->{'category'}) ||
$line->[$offsets->{'category'}] =~ m/$loggableCategory/i))
135:    {
136:      $prodtype  = File::Sale::TYPE_TRACK;
137:      $format    = File::Sale::FORMAT_TETHERED;
138:    }
139:    elsif ($line->[$offsets->{'prodtype'}] =~ m/^Permanent Albums$/i)
140:    {
141:      $prodtype  = File::Sale::TYPE_ALBUM;
142:      $format    = File::Sale::FORMAT_DOWNLOAD;
143:    }
144:    elsif ($line->[$offsets->{'prodtype'}] =~ m/^Permanent A ?la
Carte Tracks$/i)
145:    {
146:      $prodtype  = File::Sale::TYPE_TRACK;
147:      $format    = File::Sale::FORMAT_DOWNLOAD;
148:    }
149:    elsif ($line->[$offsets->{'prodtype'}] =~ m/^Permanent Album
Tracks$/i)
150:    {
151:      $prodtype  = File::Sale::TYPE_TRACK;
152:      $format    = File::Sale::FORMAT_DOWNLOAD;
153:    }
154:    elsif ($line->[$offsets->{'prodtype'}] =~ m/^Permanent
Downloads$/i)
155:    {
156:      $prodtype  = File::Sale::TYPE_TRACK;
157:      $format    = File::Sale::FORMAT_DOWNLOAD;
158:    }
159:    elsif ($line->[$offsets->{'prodtype'}] =~ m/^Permanent
Subscription Token Tracks$/i)
160:    {
161:      $prodtype  = File::Sale::TYPE_TRACK;
162:      $format    = File::Sale::FORMAT_DOWNLOAD;
163:    }
164:    my $vendorID  = $line->[$offsets->{'vendorid'}];
165:    my $clientID  =
($offsets->{'clientid'})?$line->[$offsets->{'clientid'}]:undef;
```

FIG. 23D

```
166:    my $upc      =
Common::Util::normalize_upc($line->[$offsets->{'upc'}]);
167:    my $isrc    =
Common::Util::normalize_isrc($line->[$offsets->{'isrc'}]);
168:    my $artist    = $line->[$offsets->{'artist'}];
169:    my $album    = $line->[$offsets->{'album'}];
170:    my $track    = $line->[$offsets->{'track'}];
171:    my $label    = $line->[$offsets->{'label'}];
172:    my $tracknum  = $line->[$offsets->{'tracknum'}] =~ m/^(\d+)$/;
173:    my ($units)    = $line->[$offsets->{'units'}] =~ m/^(-?\d+)$/;
174:    my $free       = 0;
175:       ## only check category if version 1
176:    $free = 1 if ((defined $offsets->{'category'}) and
$line->[$offsets->{'category'}] =~ m/^TRIAL$/i and
177:                  ($format eq File::Sale::FORMAT_STREAM or $format
eq File::Sale::FORMAT_TETHERED));
178:    if ($prodtype && $units && ($artist || $album || $track))
179:    {
180:      my $sale = SaleRec->new();
181:      $sale->productType($prodtype);
182:      $sale->formatType($format);
183:      $sale->dateBegin($dateBegin);
184:      $sale->dateEnd($dateEnd);
185:      $sale->serviceProductID($vendorID);
186:      $sale->clientProductID($clientID);
187:      $sale->upc($upc);
188:      $sale->isrc($isrc);
189:      $sale->artistName($artist);
190:      $sale->albumName($album);
191:      $sale->trackName($track);
192:      $sale->labelName($label);
193:      $sale->trackNum($tracknum);
194:      $sale->units($units);
195:      $sale->currencyCode($currencyCode);
196:      $sale->conversionRate($conversionRate);
197:      $sale->countryCode($countryCode);
198:      $sale->lineNum($linenum);
199:      $sale->free($free);
200:          ##$args{dumper}($sale);  ## for cmd-line testing
201:      $self->_insertSale(sale => $sale);
202:        }
203:    $linenum++;
204:  }
205:  return $linenum;
206: }
```

*FIG. 23E*

```
1: sub FindBestMatch {
2:   my $self = shift;
3:   my(%in) = @_;
4:   # check to see if we have a previous map entry for this input data
5:   # if we do, then we can short-circuit the normal search
6:   if (my $result = $self->_search_product_input_map($in{data})) {
7:     return $result if defined $result;
8:   }
9:     return undef if $in{map_only};
10: #  if (my $result = $self->_lookup_by_client_product_id($in{data})) {
11: #    return $result;
12: #  }
13:   if (my $result =
$self->_lookup_upc_by_client_product_id($in{data})) {
14:     return $result;
15:   }
16:   if (my $result = $self->_lookup_by_upc_alt($in{data})) {
17:     return $result;
18:   }
19:   my $data = (exists $in{data}) ? $in{data} : undef;
20:   my $min_match_level = (exists $in{min_match_level} &&
$in{min_match_level}) ? $in{min_match_level} : 90;
21:   my $min_rec_level = (exists $in{min_rec_level} &&
$in{min_rec_level}) ? $in{min_rec_level} : 70;
22:   my $skip_regexp_search = (exists $in{skip_regexp_search} &&
$in{skip_regexp_search}) ? $in{skip_regexp_search} : 0;
23:   my $skip_rec = (exists $in{skip_rec} && $in{skip_rec}) ? 1 : 0;
24:   $data->{min_level} = ($skip_rec) ? $min_match_level :
$min_rec_level;
25:   my $match_strings = $self->GetMatchPatterns(@_);
26:   my $match_strings_joined = join("'","', keys %$match_strings);
27:   my $sql = qq{SELECT product_id, pattern, level
28:          FROM product_pattern_match
29:          WHERE match_md5 in ('$match_strings_joined')
30:          AND level >= ?
31:          ORDER BY level desc
32:          };
33:   my $sth = $self->dbh()->prepare($sql);
34:   $sth->execute($data->{min_level});
35:   my (@exact, @fuzzy, @some, @rec);
36:   my $detail = {};
37:   while (my($product_id, $pattern, $level) = $sth->fetchrow_array) {
38:      next if exists $detail->{$product_id};
39:      if ($level < $min_match_level && $level >= $min_rec_level) {
40:      push @rec, $product_id;
```

FIG. 24A

```
41:     $detail->{$product_id} = {level => $level, type => 'rec',
pattern => $pattern};
42:     } elsif ($pattern eq $data->{input_pattern}) {
43:     push @exact, $product_id;
44:     $detail->{$product_id} = {level => $level, type => 'exact',
pattern => $pattern};
45:     } elsif ($self->pattern_mask($pattern) eq
$data->{input_pattern}) {
46:     push @fuzzy, $product_id;
47:     $detail->{$product_id} = {level => $level, type => 'fuzzy',
pattern => $pattern};
48:     } else {
49:     push @some, $product_id;
50:     $detail->{$product_id} = {level => $level, type => 'some',
pattern => $pattern};
51:     }
52:   }
53:   $sth->finish();
54:   my $products = [];
55:   if (scalar @exact) {
56:     $products = \@exact;
57:   } elsif (scalar @fuzzy) {
58:     $products = \@fuzzy;
59:   } elsif (scalar @some) {
60:     $products = \@some;
61:   }
62:   # if we don't find any matches, do a regexp search
63:   unless (scalar @$products == 1 || $skip_regexp_search) {
64:     unless (defined $self->{regexp_sql}) {
65:     $self->_init_regexp_search();
66:     }
67:    my %regexp_products_seen;
68:    my %regexp_rec_products_seen;
69:    SEARCH: foreach my $sql_href (@{$self->{regexp_sql}}) {
70:     next SEARCH unless $sql_href->{type} eq $data->{product_type};
71:     next SEARCH unless $sql_href->{level} >= $data->{min_level};
72:     my @params;
73:     foreach my $param (@{$sql_href->{params}}) {
74:       my($start_regexp, $param_name, $end_regexp) = $param =~
m/^(\%?)(\w+)(\%?)$/;
75:       # abandon this query if one of our required input parameters
is an empty string
76:       next SEARCH if ($data->{$param_name} eq '');
77:       my $param_value = $start_regexp . $data->{$param_name} .
$end_regexp;
78:       push @params, $param_value;
79:     }
80:     #warn sprintf "%s\n", join ("\t", @params);
81:     unless ( $sql_href->{sth}->execute(@params) ) {
82:       $self->{errstr} = "can't execute sql for id "
$sql_href->{id} . ": " . $self->dbh()->errstr;
83:       return undef;
84:     }
```

FIG. 24B

```
85:      while (my($product_id) = $sql_href->{sth}->fetchrow_array()) {
86:        if ($sql_href->{level} < $min_match_level &&
$sql_href->{level} >= $min_rec_level) {
87:          next if exists $regexp_products_seen{$product_id};
88:          push @rec, $product_id;
89:          $detail->{$product_id} = {level => $sql_href->{level}, type
=> 'regexp_rec', pattern => $sql_href->{id}};
90:           $regexp_products_seen{$product_id}++;
91:        } else {
92:          next if exists $regexp_rec_products_seen{$product_id};
93:          push @$products, $product_id;
94:          $detail->{$product_id} = {level => $sql_href->{level}, type
=> 'regexp', pattern => $sql_href->{id}};
95:           $regexp_rec_products_seen{$product_id}++;
96:        }
97:      }
98:      }
99:  }
100:    if ($data->{product_type} eq '2') {
101:        my @physicals;
102:        if ($data->{upc}) {
103:          my $sql = "SELECT product_id, album_name FROM
product_catalog_extract ".
104:                    "WHERE product_type = '2' AND (upc = ? OR upc
LIKE '".$data->{upc}."_')";
105:            print STDERR "$sql\n";
106:          my $sth = $self->dbh()->prepare($sql);
107:          $sth->execute($data->{upc});
108:          while (my($product_id, $album_name) = $sth->fetchrow_array)
{
109:              if ($data->{album_name} ne "") {
110:                 next unless
(word_containment($data->{album_name}, $album_name));
111:              }
112:              push @physicals, $product_id;
113:            }
114:            $sth->finish();
115:        } else {
116:          my $sql = "SELECT product_id FROM product_catalog_extract ".
117:                    "WHERE product_type = '2' AND album_name = ?";
118:          my $sth = $self->dbh()->prepare($sql);
119:          $sth->execute($data->{album});
120:          while (my($product_id) = $sth->fetchrow_array) {
121:              push @physicals, $product_id;
122:            }
123:            $sth->finish();
124:        }
125:        $products = \@physicals;
126:    }
127:   my $num_products = scalar @$products;
128:   my $num_rec_products = scalar @rec;
```

FIG. 24C

```
129:  if ($skip_rec == 0 && $num_products == 0 && $num_rec_products == 0)
{
130:    my @rec_search;
131:    my $search_num = 0;
132:    my $data_norm_substr = {};
133:    foreach my $key (qw(artist album track)) {
134:      $data_norm_substr->{$key} = substr( norm($data->{$key}), 0, 5);
135:    }
136:    if ($data->{product_type} eq 'T') {
137:      DEBUG && printf STDERR "PRODUCT_SEARCH: search_num=%d,
product_type=%s\n", ++$search_num, $data->{product_type};
138:      push @rec_search, ($self->_product_search(
139:                          fields => {
140:                              artist_norm =>
$data_norm_substr->{artist},
141:                              album_norm =>
$data_norm_substr->{album},
142:                              track_norm =>
$data_norm_substr->{track}
143:                            },
144:                          regexp => 'right',
145:                          product_type => 'T',
146:                          bool_terms => 'OR',
147:                          bool_fields => 'AND'
148:                          )
149:                );
150:      DEBUG && printf STDERR "PRODUCT_SEARCH: search_num=%d,
product_type=%s\n", ++$search_num, $data->{product_type};
151:      push @rec_search, ($self->_product_search(
152:                          fields => {
153:                              artist_norm =>
$data_norm_substr->{artist},
154:                              album_norm =>
$data_norm_substr->{album},
155:                            },
156:                          regexp => 'right',
157:                          product_type => 'T',
158:                          bool_terms => 'OR',
159:                          bool_fields => 'AND'
160:                          )
161:                );
162:      DEBUG && printf STDERR "PRODUCT_SEARCH: search_num=%d,
product_type=%s\n", ++$search_num, $data->{product_type};
163:      push @rec_search, ($self->_product_search(
164:                          fields => {
165:                              track_norm =>
$data_norm_substr->{track},
166:                            },
167:                          regexp => 'right',
168:                          product_type => 'T',
169:                          bool_terms => 'AND',
170:                          bool_fields => 'AND'
171:                          )
172:                );
173:    }
```

FIG. 24D

```
174:    elsif ($data->{product_type} eq 'A') {
175:      DEBUG && printf STDERR "PRODUCT_SEARCH: search_num=%d,
product_type=%s\n", ++$search_num, $data->{product_type};
176:      push @rec_search, ($self->_product_search(
177:                              fields => {
178:                                    artist_norm =>
$data_norm_substr->{artist},
179:                                    album_norm =>
$data_norm_substr->{album},
180:                                  },
181:                              regexp => 'right',
182:                              product_type => 'A',
183:                              bool_terms => 'OR',
184:                              bool_fields => 'AND'
185:                              )
186:                  );
187:      DEBUG && printf STDERR "PRODUCT_SEARCH: search_num=%d,
product_type=%s\n", ++$search_num, $data->{product_type};
188:      push @rec_search, ($self->_product_search(
189:                              fields => {
190:                                    artist_norm =>
$data_norm_substr->{artist},
191:                                  },
192:                              regexp => 'right',
193:                              product_type => 'A',
194:                              bool_terms => 'AND',
195:                              bool_fields => 'AND'
196:                              )
197:                  );
198:    } elsif ($data->{product_type} eq '2') {
199:      DEBUG && printf STDERR "PRODUCT_SEARCH: search_num=%d,
product_type=%s\n", ++$search_num, $data->{product_type};
200:      push @rec_search, ($self->_product_search(
201:                              fields => {
202:                                    upc => $data->{upc},
203:                                    album_norm =>
$data_norm_substr->{album},
204:                                  },
205:                              regexp => 'right',
206:                              product_type => '2',
207:                              bool_terms => 'OR',
208:                              bool_fields => 'AND'
209:                              )
210:                  );
```

*FIG. 24E*

```
211:    DEBUG && printf STDERR "PRODUCT_SEARCH: search_num=%d,
product_type=%s\n", ++$search_num, $data->{product_type};
212:    push @rec_search, ($self->_product_search(
213:                    fields => {
214:                        album_norm =>
norm($data->{album}),
215:                    },
216:                    regexp => 'none',
217:                    product_type => '2',
218:                    bool_terms => 'AND',
219:                    bool_fields => 'AND'
220:                    )
221:            );
222:    DEBUG && printf STDERR "PRODUCT_SEARCH: search_num=%d,
product_type=%s\n", ++$search_num, $data->{product_type};
223:    push @rec_search, ($self->_product_search(
224:                    fields => {
225:                        upc => $data->{upc},
226:                    },
227:                    regexp => 'right',
228:                    product_type => '2',
229:                    bool_terms => 'AND',
230:                    bool_fields => 'AND'
231:                    )
232:            );
233:    DEBUG && printf STDERR "PRODUCT_SEARCH: search_num=%d,
product_type=%s\n", ++$search_num, $data->{product_type};
234:    push @rec_search, ($self->_product_search(
235:                    fields => {
236:                        artist_norm =>
$data_norm_substr->{artist},
237:                    },
238:                    regexp => 'both',
239:                    product_type => '2',
240:                    bool_terms => 'AND',
241:                    bool_fields => 'AND'
242:                    )
243:            );
244:    DEBUG && printf STDERR "PRODUCT_SEARCH: search_num=%d,
product_type=%s\n", ++$search_num, $data->{product_type};
245:    push @rec_search, ($self->_product_search(
246:                    fields => {
247:                        album_norm =>
$data_norm_substr->{album},
248:                    },
249:                    regexp => 'right',
250:                    product_type => '2',
251:                    bool_terms => 'AND',
252:                    bool_fields => 'AND'
253:                    )
254:            );
255:    }
```

FIG. 24F

```
256:     my %seen;
257:     foreach my $prod_id (@rec_search) {
258:       next if $seen{$prod_id};
259:       push @rec, $prod_id;
260:       last if scalar @rec >= 10;
261:       $seen{$prod_id}++;
262:       $detail->{$prod_id} = {level => 60, type => 'autosearch',
pattern => undef};
263:     }
264:   }
265:   my $import_status;
266:   if ($num_products == 1) {
267:     $import_status = STATUS_MATCH;
268:   }
269:   elsif ($num_products == 0) {
270:     $import_status = STATUS_NOMATCH;
271:   }
272:   elsif ($num_products > 1) {
273:     $import_status = STATUS_MULTIMATCH;
274:   }
275:   my $result =  new Sale::Match::Result(
276:                         products => $products,
277:                         num_products => $num_products,
278:                         import_status => $import_status,
279:                         map_id => undef,
280:                         rec_products => \@rec,
281:                         search_products => [],
282:                         detail => $detail
283:                        );
284:   if (defined $result) {
285:     return $result;
286:   }
287:   else {
288:     $self->{errstr} = "Could not return results!";
289:     return undef;
290:   }
291: }
```

FIG. 24G

WEB-BASED SYSTEM PROVIDING ROYALTY PROCESSING AND REPORTING SERVICES

CROSS REFERENCE TO RELATED APPLICATIONS

The present application is related to and claims the benefit of priority of the following commonly-owned, presently-pending provisional application(s): application Ser. No. 60/767,569, filed Aug. 23, 2006, entitled "Web-based System Providing Royalty Processing and Reporting Services", of which the present application is a non-provisional application thereof. The disclosure of the foregoing application is hereby incorporated by reference in its entirety, including any appendices or attachments thereof, for all purposes.

COPYRIGHT STATEMENT

A portion of the disclosure of this patent document contains material which is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

APPENDIX DATA

Computer Program Listing Appendix under Sec. 1.52(e):

This application includes a transmittal under 37 C.F.R. Sec. 1.52(e) of a Computer Program Listing Appendix. The Appendix, which comprises text file(s) that are IBM-PC machine and Microsoft Windows Operating System compatible, includes the below-listed file(s). All of the material disclosed in the Computer Program Listing Appendix can be found at the U.S. Patent and Trademark Office archives and is hereby incorporated by reference into the present application.

Object Description: SourceCode.txt, size: 122590 Bytes, created: 08/23/2006 12:30:22 PM;

Object ID: File No. 1; Object Contents: Source code.

BACKGROUND OF INVENTION

1. Field of the Invention

The present invention relates generally to managing digital media assets and, more specifically, to processing and reporting royalties for media assets.

2. Description of the Background Art

Traditionally, consumers have purchased music by buying physical media at retail music stores. After browsing compact discs (CDs) or cassette tapes of interest, the consumer proceeds to a checkout register to pay for the music being purchased. In recent years, however, the Internet has popularized the electronic purchase and delivery of music to consumers. Efficient file formats, such as MP3, have made the size of digital media assets (i.e., media files) small enough to make their download via the Internet not only practical but highly advantageous.

Today, consumers purchase music from online media services or "music stores," including for example Apple itunes, EMusic, Rhapsody, Napster, Yahoo Music, MSN Music, and MusicMatch, to name a few. Using an online music store, consumers may purchase music either as individual music tracks or in albums of songs, for direct download to one's own computer. When a consumer desires to acquire (e.g., purchase or rent) a media content item (e.g., a digital music file, digital video file, electronic book (e-book) file, or other digital media), the consumer uses a Web-enabled device (e.g., Internet-connected personal computer or cell phone) to communicate with the online service. The service enables the consumer to browse and search for a desired media content item, and download purchased items to the consumer's device. Once stored on the consumer's own device, items can be "played" (i.e., rendered).

Each online music store provides music management software that gives the consumer the ability to organize their music into playlists, convert music into a different (e.g., MP3, AIFF, WAV, AAC, and the like), and transfer music between the personal computer and a portable music player (e.g., MP3 player). Although the digitization of media content was first popularized with music, practically all other media assets—including movies, music videos, educational content, television shows, live events, advertising, literary works, and the like—have been digitized to allow content suppliers to derive revenues from these assets in a digital marketplace.

Downloaded media files themselves are typically protected by Digital Rights Management (DRM) encoding, such as Apple Computer's FairPlay encoding, which prevents the playback of purchased media files on unauthorized media players. However, consumer access to media content may be controlled by a variety of methods, depending on the needs of the media service and content owners. Rhapsody, for example, offers a subscription plan that allows users unlimited media streaming and burning to CD. This flexibility, which stems from the digital nature of the media assets, supports a variety of different business models, providing convenience to consumers and increased revenue for content owners and suppliers.

Notwithstanding the obvious benefits of the digital distribution of media content, content owners and suppliers themselves are ill-equipped to track and manage associated royalty obligations. Consider the following problem. Each online service must generate quarterly royalty statements for hundreds (or even thousands) of record labels ("Labels") and thousands of music publishers. With the explosion of digital music, the music industry now faces an urgent problem: how do record companies and music publishers accurately report royalties owed to recording artists and songwriters. The problem has become particularly acute because of the shift from distributing music in physical form to digital download, resulting in the generation of hundreds of millions of transactions by online music services. This has become a massive data processing problem that is posing critical accounting challenges for the Labels and music publishers.

Given increasing consumer demand for digital media content and features, online purchase and distribution of all sorts of media content can only be expected to increase. This trend is coupled with a need for an easy-to-use, web-based royalty processing and reporting service for content providers and the entertainment industry. The present invention fulfills this and other needs.

SUMMARY OF INVENTION

A computer-implemented system providing Web-based royalty processing and reporting is described. In one embodiment, for example, a computer-implemented method of the present invention is described for automatic identification of media items subject to royalty obligations, the method comprises steps of: receiving sales input from a user comprising media items subject to royalty obligations; parsing the sales input to extract for each media item a set of fields characterizing that media item; deriving a plurality of signatures for each media item, based on different combinations of the fields for that media item; comparing the derived signatures for each media item against a database storing signatures of known media items; based on the comparison, automatically identifying media items present in the sales input; and reporting the automatically identified media items to the user.

In another embodiment, for example, a system of the present invention is described for automatic identification of media items subject to royalty obligations, which comprises: a user interface manager for receiving from a user sales input comprising media items subject to royalty obligations; a file processing engine for parsing the sales input to extract for each media item a set of fields characterizing that media item; a database storing metadata comprising signatures of known media items; a matching engine for deriving a plurality of signatures for each media item based on different combinations of the fields for that media item, and for automatically identifying media items present in the sales input based on comparison of the derived signatures for each media item against signatures stored in the database.

BRIEF DESCRIPTION OF DRAWINGS

FIG. 2 is a diagram illustrating a standard header and navigation bar.

FIG. 3 is a diagram illustrating a Log-in form, which is displayed whenever a user needs to log in.

FIG. 4 is a diagram illustrating a Select a Site page.

FIG. 5 is a diagram illustrating a Digital Sales Dashboard.

FIG. 8 is a diagram illustrating a Top Albums page.

FIG. 9 is a diagram illustrating a Top Tracks page.

FIGS. 14A-B are diagrams illustrating a Royalty Status Tracker page and supporting page.

FIGS. 15A-D are diagrams illustrating a Manage Import page and supporting pages.

FIGS. 16A-B are diagrams illustrating a Stream Revenue page and supporting page.

FIGS. 17A-D are diagrams illustrating a Finish Import page and supporting pages.

FIG. 18 is a diagram illustrating a User Summary page.

FIG. 19 is a diagram illustrating a User Entry page.

FIG. 20 is a diagram illustrating a Contact page.

FIGS. 23A-E illustrate source code embodiment for a subclassed importer that is associated with the MusicNet music service.

FIGS. 24A-G illustrate source code embodiment for a FindBestMatch subroutine.

DETAILED DESCRIPTION

Glossary

Figure 1:
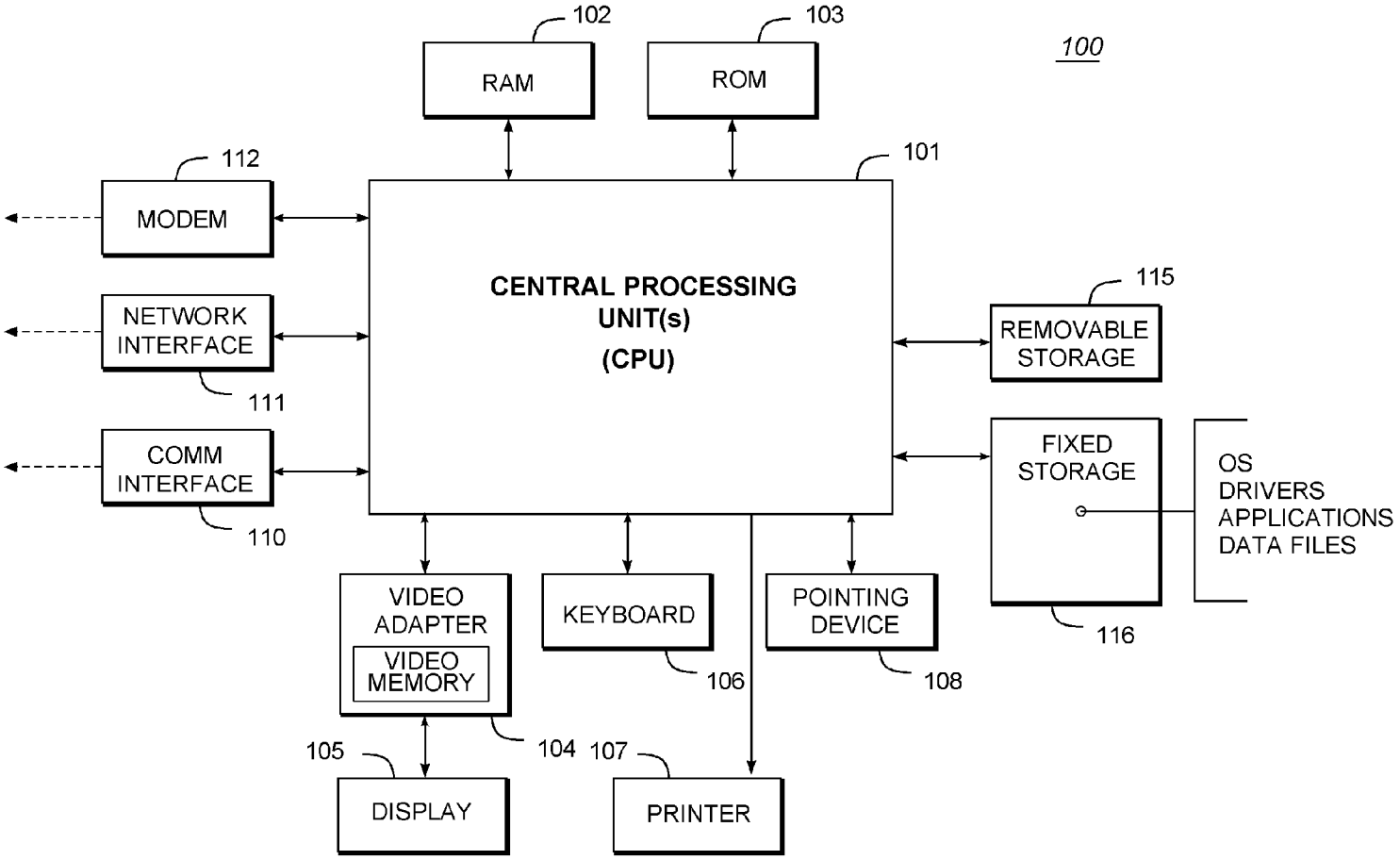
FIG. 1 (PRIOR ART)
FIG. 1 is a very general block diagram of a computer system (e.g., an IBM-compatible system) in which software-implemented processes of the present invention may be embodied.

The following definitions are offered for purposes of illustration, not limitation, in order to assist with understanding the discussion that follows.

Administrator ("admin"): An individual responsible for maintaining a multi-user computer system, including a local-area network (LAN). Typical duties include adding and configuring new workstations; setting up user accounts; installing system-wide software; and allocating storage space.

ISRC: Abbreviation for International Standard Recording Code, which is the international identification system for sound recordings and music videorecordings. Each ISRC is a unique and permanent identifier for a specific recording that can be permanently encoded into a product as its digital fingerprint. Encoded ISRC provide the means to automatically identify recordings for royalty payments.

Label (Record Label): Shorthand used to refer to a content owner, such as a Record Label (e.g., EMI).

MD5: A message-digest algorithm that takes as input a message of arbitrary length and produces as output a 128-bit "fingerprint" or "message digest" of the input. Further description of MD5 is available in "RFC 1321: The MD5 Message-Digest Algorithm", (April 1992), the disclosure of which is hereby incorporated by reference. A copy of RFC 1321 is available via the Internet (e.g., currently at www.ietf.org/rfc/rfc1321.txt).

Network: A network is a group of two or more systems linked together. There are many types of computer networks, including local area networks (LANs), virtual private networks (VPNs), metropolitan area networks (MANs), campus area networks (CANs), and wide area networks (WANs) including the Internet. As used herein, the term "network" refers broadly to any group of two or more computer systems or devices that are linked together from time to time (or permanently).

Perl: Short for Practical Extraction and Report Language, Perl is a programming language developed by Larry Wall, especially designed for processing text. Because of its strong text processing abilities, Perl has become one of the most popular languages for writing CGI scripts.

Relational database: A relational database is a collection of data items organized as a set of formally-described tables from which data can be accessed or reassembled in many different ways without having to reorganize the database tables. The relational database was invented by E. F. Codd at IBM in 1970. A relational database employs a set of tables containing data fitted into predefined categories. Each table (which is sometimes called a relation) contains one or more data categories in columns. A feature of a relational database is that users may define relationships between the tables in order to link data that is contained in multiple tables. The standard user and application program interface to a relational database is the Structured Query Language (SQL), defined below.

SQL: SQL stands for Structured Query Language. The original version called SEQUEL (structured English query language) was designed by IBM in the 1970's. SQL-92 (or SQL/92) is the formal standard for SQL as set out in a document published by the American National Standards Institute in 1992; see e.g., "Information Technology—Database languages—SQL", published by the American National Standards Institute as American National Standard ANSI/ISO/IEC 9075: 1992, the disclosure of which is hereby incorporated by reference. SQL-92 was superseded by SQL-99 (or SQL3) in 1999; see e.g., "Information Technology—Database Languages—SQL, Parts 1-5" published by the American National Standards Institute as American National Standard INCITS/ISO/IEC 9075-(1-5)-1999 (formerly ANSI/ISO/IEC 9075-(1-5)-1999), the disclosure of which is hereby incorporated by reference.

UPC: Stands for Universal Product Code, which is one of a wide variety of bar code languages called symbologies. The UPC was the original barcode widely used in the United States and Canada for items in stores.

URL: URL is an abbreviation of Uniform Resource Locator, the global address of documents and other resources on the World Wide Web. The first part of the address indicates what protocol to use, and the second part specifies the IP address or the domain name where the resource is located.

XML: XML stands for Extensible Markup Language, a specification developed by the World Wide Web Consortium (W3C). XML is a pared-down version of the Standard Generalized Markup Language (SGML), a system for organizing and tagging elements of a document. XML is designed especially for Web documents. It allows designers to create their own customized tags, enabling the definition, transmission, validation, and interpretation of data between applications and between organizations. For further description of XML, see e.g., "Extensible Markup Language (XML) 1.0", (2nd Edition, Oct. 6, 2000) a recommended specification from the W3C, the disclosure of which is hereby incorporated by reference. A copy of this specification is available via the Internet (e.g., currently at www.w3.org/TR/REC-xml).

Introduction

Referring to the figures, exemplary embodiments of the invention will now be described. The following description will focus on the presently preferred embodiment of the present invention, which is implemented in desktop and/or server software (e.g., driver, application, or the like) operating in an Internet-connected environment running under an operating system, such as the Microsoft Windows operating system. The present invention, however, is not limited to any one particular application or any particular environment. Instead, those skilled in the art will find that the system and methods of the present invention may be advantageously embodied on a variety of different platforms, including Macintosh, Linux, Solaris, UNIX, FreeBSD, and the like. Therefore, the description of the exemplary embodiments that follows is for purposes of illustration and not limitation. The exemplary embodiments are primarily described with reference to block diagrams or flowcharts. As to the flowcharts, each block within the flowcharts represents both a method step and an apparatus element for performing the method step. Depending upon the implementation, the corresponding apparatus element may be configured in hardware, software, firmware, or combinations thereof.

Computer-Based Implementation

Basic System Hardware and Software (e.g., for Desktop and Server Computers)

The present invention may be implemented on a conventional or general-purpose computer system, such as an IBM-compatible personal computer (PC) or server computer. FIG. 1 is a very general block diagram of a computer system (e.g., an IBM-compatible system) in which software-implemented processes of the present invention may be embodied. As shown, system 100 comprises a central processing unit(s) (CPU) or processor(s) 101 coupled to a random-access memory (RAM) 102, a read-only memory (ROM) 103, a keyboard 106, a printer 107, a pointing device 108, a display or video adapter 104 connected to a display device 105, a removable (mass) storage device 115 (e.g., floppy disk, CD-ROM, CD-R, CD-RW, DVD, or the like), a fixed (mass) storage device 116 (e.g., hard disk), a communication (COMM) port(s) or interface(s) 110, a modem 112, and a network interface card (NIC) or controller 111 (e.g., Ethernet). Although not shown separately, a real time system clock is included with the system 100, in a conventional manner.

CPU 101 comprises a processor of the Intel Pentium family of microprocessors. However, any other suitable processor may be utilized for implementing the present invention. The CPU 101 communicates with other components of the system via a bi-directional system bus (including any necessary input/output (I/O) controller circuitry and other "glue" logic). The bus, which includes address lines for addressing system memory, provides data transfer between and among the various components. Description of Pentium-class microprocessors and their instruction set, bus architecture, and control lines is available from Intel Corporation of Santa Clara, Calif. Random-access memory 102 serves as the working memory for the CPU 101. In a typical configuration, RAM of sixty-four megabytes or more is employed. More or less memory may be used without departing from the scope of the present invention. The read-only memory (ROM) 103 contains the basic input/output system code (BIOS)—a set of low-level routines in the ROM that application programs and the operating systems can use to interact with the hardware, including reading characters from the keyboard, outputting characters to printers, and so forth.

Mass storage devices 115, 116 provide persistent storage on fixed and removable media, such as magnetic, optical or magnetic-optical storage systems, flash memory, or any other available mass storage technology. The mass storage may be shared on a network, or it may be a dedicated mass storage. As shown in FIG. 1, fixed storage 116 stores a body of program and data for directing operation of the computer system, including an operating system, user application programs, driver and other support files, as well as other data files of all sorts. Typically, the fixed storage 116 serves as the main hard disk for the system.

In basic operation, program logic (including that which implements methodology of the present invention described below) is loaded from the removable storage 115 or fixed storage 116 into the main (RAM) memory 102, for execution by the CPU 101. During operation of the program logic, the system 100 accepts user input from a keyboard 106 and pointing device 108, as well as speech-based input from a voice recognition system (not shown). The keyboard 106 permits selection of application programs, entry of keyboard-based input or data, and selection and manipulation of individual data objects displayed on the screen or display device 105. Likewise, the pointing device 108, such as a mouse, track ball, pen device, or the like, permits selection and manipulation of objects on the display device. In this manner, these input devices support manual user input for any process running on the system.

The computer system 100 displays text and/or graphic images and other data on the display device 105. The video adapter 104, which is interposed between the display 105 and the system's bus, drives the display device 105. The video adapter 104, which includes video memory accessible to the CPU 101, provides circuitry that converts pixel data stored in the video memory to a raster signal suitable for use by a cathode ray tube (CRT) raster or liquid crystal display (LCD)

monitor. A hard copy of the displayed information, or other information within the system 100, may be obtained from the printer 107, or other output device. Printer 107 may include, for instance, an HP LaserJet printer (available from Hewlett Packard of Palo Alto, Calif.), for creating hard copy images of output of the system.

The system itself communicates with other devices (e.g., other computers) via the network interface card (NIC) 111 connected to a network (e.g., Ethernet network, Bluetooth wireless network, or the like), and/or modem 112 (e.g., 56K baud, ISDN, DSL, or cable modem), examples of which are available from 3Com of Santa Clara, Calif. The system 100 may also communicate with local occasionally-connected devices (e.g., serial cable-linked devices) via the communication (COMM) interface 110, which may include a RS-232 serial port, a Universal Serial Bus (USB) interface, or the like. Devices that will be commonly connected locally to the interface 110 include laptop computers, handheld organizers, digital cameras, and the like.

IBM-compatible personal computers and server computers are available from a variety of vendors. Representative vendors include Dell Computers of Round Rock, Tex., Hewlett-Packard of Palo Alto, Calif., and IBM of Armonk, N.Y. Other suitable computers include Apple-compatible computers (e.g., Macintosh), which are available from Apple Computer of Cupertino, Calif., and Sun Solaris workstations, which are available from Sun Microsystems of Mountain View, Calif.

A software system is typically provided for controlling the operation of the computer system 100. The software system, which is usually stored in system memory (RAM) 102 and on fixed storage (e.g., hard disk) 116, includes a kernel or operating system (OS) which manages low-level aspects of computer operation, including managing execution of processes, memory allocation, file input and output (I/O), and device I/O. The OS can be provided by a conventional operating system, Microsoft Windows NT, Microsoft Windows 2000, Microsoft Windows XP, or Microsoft Windows Vista (Microsoft Corporation of Redmond, Wash.) or an alternative operating system, such as the previously mentioned operating systems. Typically, the OS operates in conjunction with device drivers (e.g., "Winsock" driver—Windows' implementation of a TCP/IP stack) and the system BIOS microcode (i.e., ROM-based microcode), particularly when interfacing with peripheral devices. One or more application(s), such as client application software or "programs" (i.e., set of processor-executable instructions), may also be provided for execution by the computer system 100. The application(s) or other software intended for use on the computer system may be "loaded" into memory 102 from fixed storage 116 or may be downloaded from an Internet location (e.g., Web server). A graphical user interface (GUI) is generally provided for receiving user commands and data in a graphical (e.g., "point-and-click") fashion. These inputs, in turn, may be acted upon by the computer system in accordance with instructions from OS and/or application(s). The graphical user interface also serves to display the results of operation from the OS and application(s).

The above-described computer hardware and software are presented for purposes of illustrating the basic underlying desktop and server computer components that may be employed for implementing the present invention. For purposes of discussion, the following description will present examples in which it will be assumed that there exists a "server" (e.g., Web server, capable of hosting methods of the present invention as Web services) that communicates with one or more "clients" (e.g., desktop computers, from which users log on to the server in order to use the Web services). The present invention, however, is not limited to any particular environment or device configuration. In particular, a client/server distinction is not necessary to the invention, but is simply a suggested framework for implementing the present invention. Instead, the present invention may be implemented in any type of system architecture or processing environment capable of supporting the methodologies of the present invention presented in detail below, including implementing the methodologies on a standalone computer (i.e., where users log on to the same computer that the computer-implemented methodologies are serviced). Additionally, the following description will focus on music service content providers (e.g., Apple itunes, which provides audio and video content to consumers) in order to simplify the discussion. However, those skilled in the art will appreciate that the system and methodologies of the present invention may be advantageously applied to manage and process royalties for all types of content that may be provided to consumers as digital media assets.

Overview

The present invention provides system and methods supporting an easy-to-use, Web-based royalty processing and reporting service for content providers and the entertainment industry. At the outset, it is helpful to understand different users of the system. At the highest level, there are two main categories of users: Record Label Users ("Label Users") and Royalty Share (RS) Users. Each category itself includes standard and administrative users (with the significant difference between the two being the individual user's ability to add, change, and disable other users).

During system use, Label Users are initially presented with a Digital Sales Dashboard that gives them a quick visual picture of their on-line music sales. From this dashboard, the users can drill further into the data and see the details of what goes into their top-line revenue from different perspectives. For example, they can see which albums and tracks are selling at which digital music services (as one might expect), but they can also see what types of sales are contributing the most to their total revenue (e.g., downloads versus streams). Label users can proceed to a "Royalty Status Tracker" to see what sales data has been received from which services and the processing status of each. They can also upload sales files themselves if they wish to do so. From this page, they can also download royalty data files for periods already completed. They can visit a Contacts page in order to get email addresses and phone numbers for various contacts (e.g., dedicated account representatives).

Royalty Share (RS) Users have access to all of the pages available to Label Users but also have access to special tools needed to manage the digital music service sales data, including a special Import Manager tool. This tool automatically recognizes files based on their content. It flags records in error and guides the account representative through the process of correcting them. The most common problem faced is the inability to associate a sales transaction with the correct album or track (i.e., titles) with absolute certainty. Rather than guess, the system will guide the account representative (rep) through a matching process based on intelligent suggestions from the catalog. The rep can also search the catalog manually if none of the suggestions seem to work either. Account reps can also access the Catalog maintenance page to view, modify, or add catalog data. This provides an easy way to make sure that the album and track data correspond to a Label's master catalog.

Royalty Share (RS) Users and Label administrators have access to a User maintenance page in order to add new users or modify existing ones. Royalty Share (RS) administrators have total control over all users in the system. Account reps, on the other hand, can only modify Label users (but for any Label client). Label administrators can only add or modify other Label users and only for their own Label. Access to the system can only be gained through the Login page. Attempts to access other parts of the application (for example, through bookmarks) before signing in will redirect the user to the User maintenance page.

Preferred User Interface for Royalty Processing, Management, and Reporting

Application Access

Each Label has its own specific URL space set aside for application and data access. For example, emerging Indiana Records (Record Label) accesses the system via the URL: indyrecords.royaltyshare.com. The URL does not have to necessarily match the Label's formal name, but should be sensible. Entering this URL will direct users who are not logged in, to the login page; otherwise it will take them to the Digital Sales Dashboard. Label users are associated with a specific Label client. If an attempt is made to access another Label's URL space, the system will complain to that effect. Royalty Share (RS) administrators and account reps can log in to any Label's space. The application can also be accessed via a general login at www.royaltyshare.com/login. This is a generic login page that takes the user to the Dashboard after they sign in. For Label Users, the system automatically takes them to the appropriate URL space. For Royalty Share (RS) Users, the system directs them to a secondary login page that asks them where they want to go next.

Header and Navigation

FIG. 2 is a diagram illustrating a standard header and navigation bar displayed at the top of each page (other than the login page). As shown, the main menu includes menu choices for: Sales, Royalties, Catalog, Users, and Contact. The function of the various menu choices will be described in further detail below. Clicking the Log out link will log the current user out of the system and return the user to the Login page.

Login

FIG. 3 is a diagram illustrating a Log-in form or page, which is displayed whenever a user needs to log in. Following a successful login, the user is taken to the page he or she originally attempted to access (or the Digital Sales Dashboard if no page was specified or if the user is not permitted to access the page they requested). If the email address/password combination cannot be validated for the user, the text "Invalid email address and/or password entered, please try again" is displayed. If the password is entirely upper or lower case, the additional text "Passwords are case sensitive, you may need to check your caps lock key" is displayed. If a Label user is attempting to login to a different Label's URL space, the text "You are not allowed to access labelspace.royaltyshare.com" is displayed. If a Royalty Share (RS) user is logging in through the www.royaltyshare.com/login page, he or she will be directed to a "Select a Site" page. The "Forgot Password?" link takes the user to a Forgot Password form (not shown).

Select a Site

FIG. 4 is a diagram illustrating the Select a Site page. Selecting a Label and clicking the "go" button will take the user to the Digital Sales Dashboard. Failing to select a Label first will display the text "Please select a Label" directly below the Label dropdown.

Digital Sales Dashboard

FIG. 5 is a diagram illustrating the Digital Sales Dashboard. The dashboard provides a high-level view especially designed for Label Users, containing all relevant bits of information in an easy-to-view interface. As shown, the main section of the screen displays clickable graphs and charts containing Top Services, Formats, Albums, and Tracks. The dashboard displays the top performers (e.g., top five performers) in each of these categories based on revenue. The dashboard also includes an "Others" item that summarizes everything else in the category.

As also shown, information is depicted graphically using 3-D pie charts. The pie chart slices and titles are clickable for each chart. Clicking titles takes the user to a more detailed view of the chart (for example, displaying the top 50 albums rather than just the top 5). Clicking an actual pie slice or album or track brings up a detailed view for that item. The header for the graph section displays the time period for which data is being reported. By default, the system uses calendar quarters (i.e., Q1 is January-March and so on). Clicking the previous and next links, the user can navigate from quarter to quarter. These links are only displayed if there is data in the quarter (that would be selected).

For Labels that market their music under multiple Label names, a dropdown list is presented that allows them to select a specific Label for display or to display the totals for all Labels combined. (It is not displayed for Labels that market under a single Label name.) Beneath the charts is a section that shows all of the services utilized by the Label and a check mark to indicate that data was received for a specific month in the quarter. Since some services deliver data quarterly, three checks are employed as feedback or a visual cue that the system has received the data as a quarterly delivery.

The page includes submenus, each corresponding to one of the four main charts on this page: Revenue by Service, Revenue by Format, Top Albums, Top Tracks, and Territories.

Revenue by Service

Figure 6:
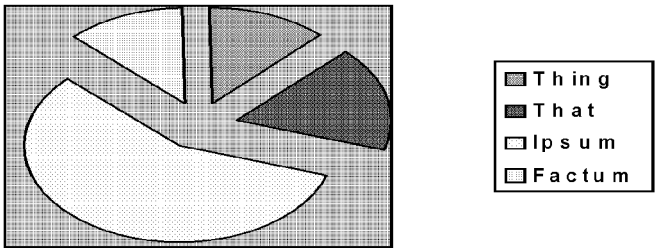
FIG. 6 is a diagram illustrating a Revenue by Service page.

FIG. 6 is a diagram illustrating the Revenue by Service page. This page contains the same navigation elements as the main Dashboard screen. Clicking a specific service pie slice take the user to a Service Revenue page detailing that service. Clicking the Top Album or Track links takes the user to the respective pages. Clicking a specific album or track title takes the user to the corresponding detail page. For the services pie chart, all services are displayed. For the top album and track listings, the top 10 for each are displayed. The sales/dashboard submenu is displayed in the header with the Revenue by Service item selected.

Revenue by Format

Figure 7:
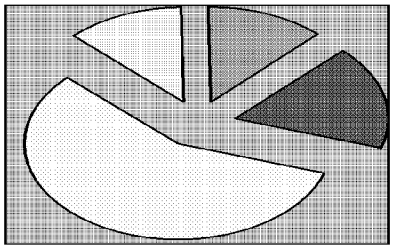
FIG. 7 is a diagram illustrating a Revenue by Format page.

FIG. 7 is a diagram illustrating the Revenue by Format page. The page contains the same navigation elements as the main dashboard screen. Clicking a specific format pie slice takes the user to a format revenue page detailing that format. Clicking the top album or track links takes the user to the respective pages. Clicking a specific album or track title takes the user to the corresponding detail page. For the formats pie chart, all formats are displayed. For the top album and track listings, the top 10 for each are displayed. The sales/dashboard submenu is displayed in the header with the Revenue by Format item selected.

Top Albums

FIG. 8 is a diagram illustrating the Top Albums page. This page contains the same navigation elements as the main dashboard screen. Clicking an album title takes the user to the detailed page for that album. Clicking the by service or format links takes the user to the revenue by service or format pages respectively. Clicking a pie slice takes the user to the corresponding detail page. In the currently preferred embodiment, the top 50 albums are displayed. If desired, the system may be configured to display more on multiple pages. For the services and formats pie charts, all services and formats will be displayed. The sales/dashboard submenu is displayed in the header with the Top Albums item selected.

Top Tracks

FIG. 9 is a diagram illustrating the Top Tracks page. This page contains the same navigation elements as the main dashboard screen. Clicking a track title takes the user to the detailed page for that track. Clicking the by service or format links takes the user to the revenue by service or format pages respectively. Clicking a pie slice takes the user to the corresponding detail page. In the currently preferred embodiment, the system displays the top 50 tracks. If desired, more tracks may be displayed on multiple pages. For the services and formats pie charts, all services and formats are displayed. The sales/dashboard submenu is displayed in the header with the Top Tracks item selected.

Service Revenue

Figure 10:
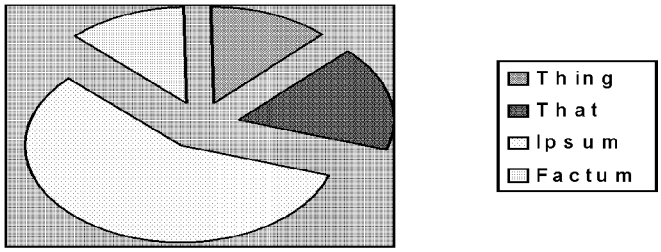
FIG. 10 is a diagram illustrating a Service Revenue page, which displays revenue information for a specific service.

FIG. 10 is a diagram illustrating the Service Revenue page, which displays revenue information for a specific service. This page is reached by clicking a specific service in various dashboard pages. The page contains the same navigation elements as the main dashboard screen. Clicking the formats link or a pie slice takes the user to the corresponding dashboard page. Clicking the top album or track links takes the user to the respective pages. Clicking a specific album or track title takes the user to the corresponding detail page. For the formats pie chart, all formats are displayed. For the top album and track listings, the top 10 for each are displayed. The sales/dashboard submenu is displayed in the header with the Revenue by Service item selected.

Format Revenue

Figure 11:
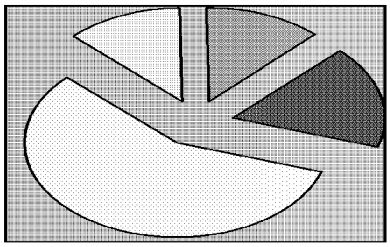
FIG. 11 is a diagram illustrating a Format Revenue page, which displays revenue information for a specific format.

FIG. 11 is a diagram illustrating the Format Revenue page, which displays revenue information for a specific format. This page is reached by clicking a specific format in various dashboard pages. The page contains the same navigation elements as the main dashboard screen. Clicking the services link or a pie slice takes the user to the corresponding dashboard page. Clicking the top album or track links takes the user to the respective pages. Clicking a specific album or track title takes the user to the corresponding detail page. For the service pie chart, all formats are displayed. For the top album and track listings, the top 10 for each are displayed. The sales/dashboard submenu is displayed in the header with the Revenue by Format item selected.

Album Revenue

Figure 12:
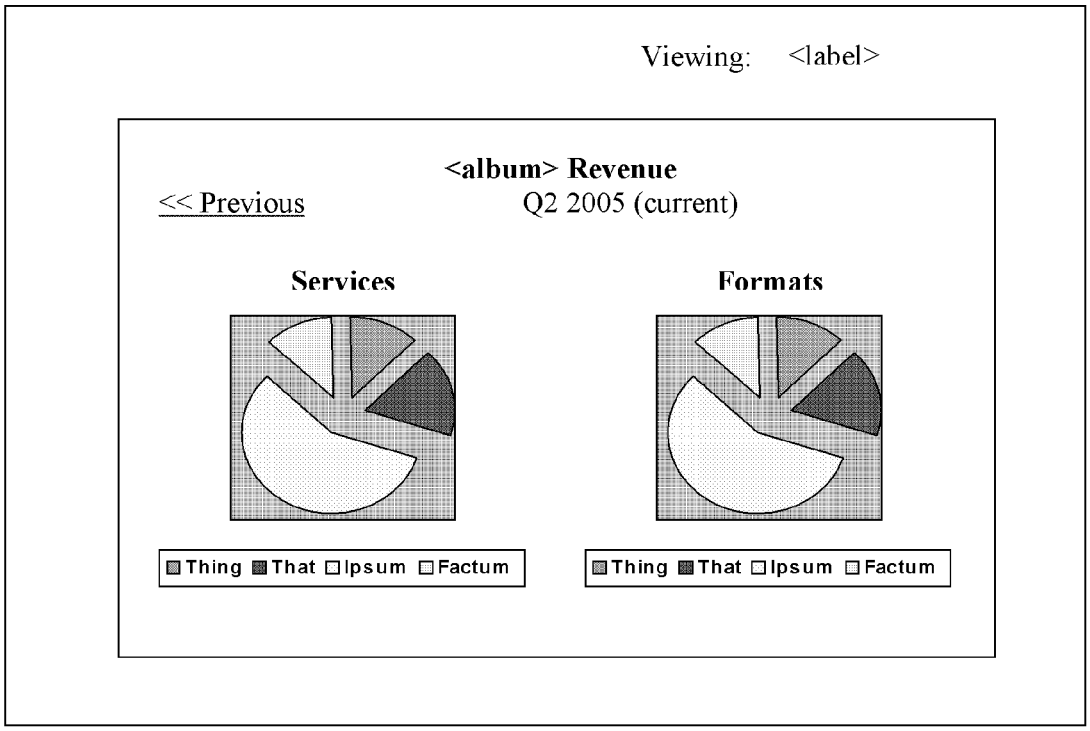
FIG. 12 is a diagram illustrating an Album Revenue page, which displays revenue information for a specific album.

FIG. 12 is a diagram illustrating the Album Revenue page, which displays revenue information for a specific album. This page is reached by clicking a specific album title in various dashboard pages. The page contains the same navigation elements as the main dashboard screen, except for the Label drop down which is now just a display item reflecting the Label for this particular album. Clicking the by service or format links takes the user to the revenue by service or format pages respectively. Clicking a pie slice takes the user to the corresponding detail page. For the services and formats pie charts, all services and formats are displayed. The sales/dashboard submenu is displayed in the header with the Top Albums item selected.

Track Revenue

Figure 13:
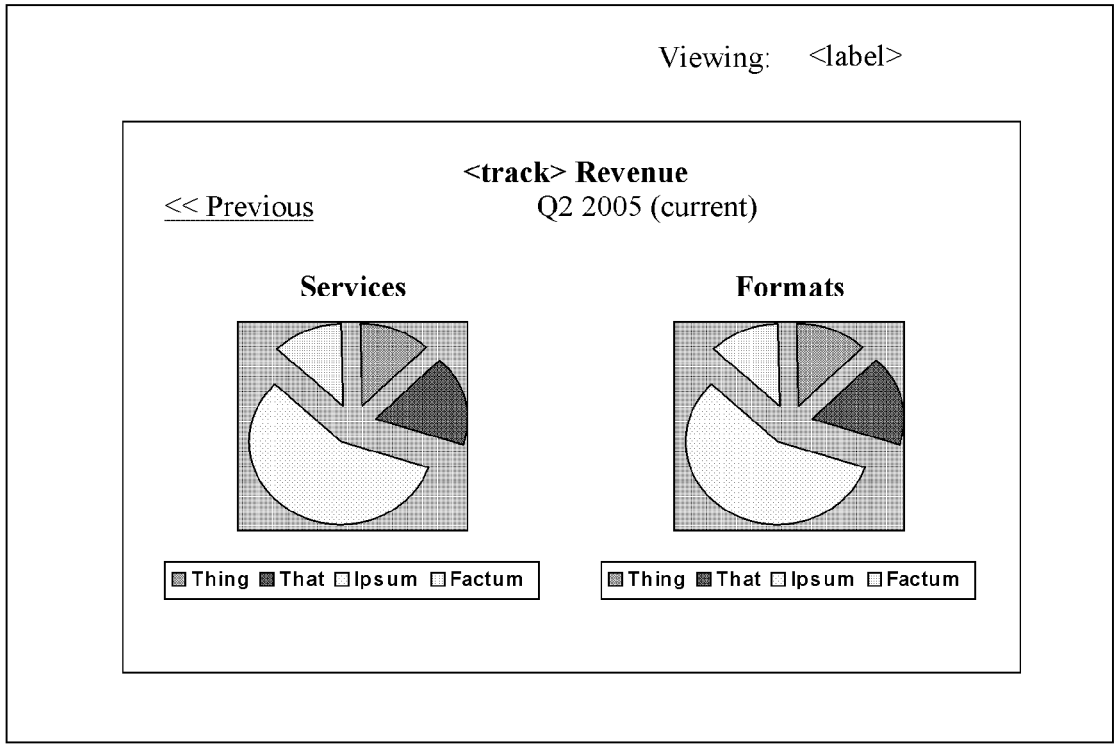
FIG. 13 is a diagram illustrating a Track Revenue page, which displays revenue information for a specific track.

FIG. 13 is a diagram illustrating the Track Revenue page, which displays revenue information for a specific track. This page is reached by clicking a specific track title in various dashboard pages. This page contains the same navigation elements as the main dashboard screen, except for the Label drop down which is now just a display item reflecting the Label for this particular track. Clicking the by service or format links takes the user to the revenue by service or format pages respectively. Clicking a pie slice takes the user to the corresponding detail page. For the services and formats pie charts, all services and formats will be displayed. The sales/dashboard submenu is displayed in the header with the Top Track item selected.

Royalty Status Tracker

FIG. 14A is a diagram illustrating the Royalty Status Tracker page. This is an advanced interface that provides everything that a Label's royalty administrator needs to see to quickly assess the status of current or prior royalty processing periods. Additionally, it is the main page a RoyaltyShare™ account representative uses to initiate most of the tasks necessary to process royalty data as it is received. As shown, the Tracker displays a summary of the files collected so far and information regarding the status of each. There is one line for each file received during the period. For prior periods, the list includes only the files that were actually processed during the period.

The "close current period" button is only displayed for account reps and only for the current period; it is not displayed if there are no sales files for the current period. Clicking the close period button takes all files that have been processed and associates them with the period being closed as a result of this action. In effect, the current period becomes the prior period with an effective date range that comprises the last close date and today. Any files that are still in a pending status stay in the "new" current period. The user is presented with a confirmation dialog (shown at FIG. 14B) before the period is actually closed. The unprocessed files portion of the message will not be presented if all files have been processed. Clicking the "Yes" button closes the period. Clicking the "No" button returns the user to the original display. Any user can navigate between periods by using the newer and older links. Newer periods will not be displayed if the user is in the current period, and older will not be displayed if the user is in the oldest one.

The exceptions section shows the number of exceptions originally found in a data file and the number still remaining that need to be addressed. Exceptions remaining will be displayed as a link for account reps whenever there is at least one exception. Clicking the link takes the rep to the Manage Import page. The processed column contains the date the file was actually processed by the system. It contains the text "Pending" if a file has not been processed yet. The pending status will be displayed as a link for account representatives except when there is no revenue (which must be entered first). Clicking the link takes the account rep to the Finish Import page.

Entries in the revenue column may also be displayed as links to account representatives. This happens when the data file contains stream sales that do not have any actual revenue per track at the time the file is produced (e.g., as is the case with Napster). Clicking this link takes the rep to the Stream Revenue page where he or she can enter the figures to be used.

The upload sales section is used by the Label or account rep to upload a new data file. The file is uploaded using the browser's standard file upload capability. Clicking the browse button invokes the standard file browse dialog to assist the user in locating the file on his or her local or network file system. The length of the filename is limited only to the extent dictated by the client browser. Clicking the upload button initiates that actual upload of the file and after transfer it is saved on the server along with the filename portion of the full path to the file (the filename will be truncated at 255 characters while retaining the original extension). If desired, multiple files may be uploaded. In the event of an uploading error, the system displays an error message, for example:

Must specify a filename.

File not found.

Unsupported file format. Must be in tab delimited or Excel format.

Unrecognized file format. Please contact your account representative.

File has already been uploaded.

If, on the other hand the upload is successful, the message "Success!<filename> has been uploaded for further processing" is displayed at the bottom of this section.

If desired, the system may be configured to delete an unprocessed (deleted) file. Here, a new page is displayed that shows large groups of errors in context and allow file(s) to be deleted from there. Additionally, a checkbox user interface element may be employed to control the display of unprocessed files, so that the user can at least hide them if he or she does not want to delete them. Also, the system may be configured to provide email notification to account rep(s) when a Label user uploads a sales file.

The download data file section is only displayed for closed royalty periods. Thus, it is not displayed for the current period. For closed periods, the user selects a file format, such as Excel, Tab Delimited, XML, Counterpoint, PLX, or the like. Clicking download will initiate the download of the file using standard browser (e.g., Microsoft Internet Explorer or Mozilla Firefox) facilities. If desired, the system may be configured to allow the user to select fields, field order and grouping for sales data with the ability to save the format and use for delivery.

Manage Import

FIG. 15A is a diagram illustrating the Manage Import page. This is used by an account representative for processing a digital service sales file. As shown, the name of the file is displayed along with the service that provided it, the number of lines in the file and the number of lines that still have issues. Below this, the type(s) of error(s) are displayed. The fields with errors are also highlighted in place, such as:

The following non-correctable conditions are detected:

| |
|---|
| <field> contains invalid date |
| <field> contains invalid numeric value |
| <field> is empty |

For non-correctable errors, the account representative can only skip to the next or previous record in error. In the currently preferred embodiment, the capability to modify individual records of a data file provided by a digital music service is not provided. However, the design of the system may be modified to provide this capability, if desired. The skip and previous links can be used to navigate between sales records without performing any action on the records.

Correctable errors are ones that may be resolved by matching to a Label's master catalog. FIG. 15B is a diagram illustrating a dialog for matching correctable errors (e.g., for album sales). In the currently preferred embodiment, up to 10 suggested matches are displayed. None of the radio buttons are initially selected and the "match to catalog" button is disabled. Selecting a radio button enables the match button and clicking it will then connect the record in error to the selected catalog entry. This connection is saved so that any sales records for the same content can be matched automatically in the future. Once the match is complete, the summary information at the top of the screen is updated and the next record in error is presented. The matched record is no longer in the set of records with errors that can be navigated using skip and previous. Furthermore, any records that may have contained a matching error but now do match as a result of the connection will no longer be presented. If desired, the system may include the capability to show matched records and "unmatch" them.

For tracks that cannot be matched, this section is instead displayed as shown in FIG. 15C. In the currently preferred embodiment, up to 10 suggested matches are displayed. This can be followed by up to some number (e.g., three) of matches based on album name, with each track on the album listed in track number order. The same process is followed for selecting the desired track and matching it to the record in error (and saving the connection for future automated matches).

Below the suggested matches section, a search section is displayed, as shown in FIG. 15D, so that account reps can search for better matches than those offered. In the currently preferred embodiment, the user may enter up to 100 characters into the search text field. Clicking the "go' button initiates the search. Words within the string are processed together to find possible matches in the catalog. Up to 10 matches will be displayed using the same format specified for the suggested album or track matches outlined previously. During the time search results are being presented for matching, a "Clear Search Results" button is displayed. Clicking this button clears the search results and returns to the album or track suggestions that were originally presented. When all exceptions have been corrected, the user (rep) is automatically taken to the Finish Import screen, provided that revenue data has be provided in the sales file. Otherwise, the user will be taken to the Stream Revenue page.

Stream Revenue

The Stream Revenue page exists solely for the purpose of entering revenue information when it is not provided with the sales data file received from a digital music service provider. This is the case with services like Napster where the stream metrics are provided on a monthly basis, but the stream revenue is calculated and delivered on a quarterly basis. FIG. 16A is a diagram illustrating the Stream Revenue page.

Operation is as follows. Clicking cancel returns the user to the Royalty Status Tracker page. A value between 1.00 and 99999.99 can be entered in the revenue field. Clicking the update revenue button displays an update revenue dialog, illustrated in FIG. 16B. Clicking the update button updates the revenue and takes the user to the Finish Import page, if he or she came here from the Manage Import page. Otherwise, the user is returned to the Royalty Status Tracker. Clicking cancel closes this message box. Internally, the per stream amount is applied to each stream unit. The system does not try to make adjustments for stream sales with exceptions. In other words, even though records might have exceptions, some of the revenue still goes with those records and should not be allocated to good sales records.

Finish Import

FIG. 17A is a diagram illustrating the Finish Import page. This page is the last step in importing a sales data file into the system. Account reps are taken to this page after they have fixed all the errors in the Manage Import page. They can also return here anytime from the Royalty Status Tracker page. If the file has no errors, clicking the finish import button will initial the final processing and import of the file into the system. Upon completion of this process, a success dialog is displayed, as shown in FIG. 17B. Upon clicking the return to status tracker link, the user is returned to the Royalty Status Tracker page.

If the file still has errors the finish import button is replaced with a "Split File" button. Clicking this button displays the confirmation dialog shown in FIG. 17C. Clicking cancel returns the user to the Finish Import page. Clicking the split button splits the files and display the success (feedback) dialog shown in FIG. 17D. When a file is split, new file names are created by appending -a and -b to the filename prior to the extension for the file. If a file is split again, the name for the -b file remains the same and the new split file is given a -c appendix (and so on, for each split). Clicking the return to status tracker link takes the user back to the Royalty Status Tracker page.

User Summary

FIG. 18 is a diagram illustrating the User Summary page. The page contains a listing of all users in the system that the currently logged-in user has permission to administrate. All Royalty Share (RS) users can access this page. Label administrators also have access, however Label users do not.

As previously described, the system employs four user levels:

Royalty Share (RS) Administrators have full access to everything in the application. They can access any Label's data.

Royalty Share (RS) Account Representatives have the same the rights as RS admins except they are not allowed to administrate Royalty Share (RS) users.

Label Users are limited to their own Label data. They are also restricted in various application areas (as described herein).

Label Administrators have the same rights as Label users with the added ability to administrate Label users.

In the currently preferred embodiment, once a user has been created, he or she cannot simply be deleted. Instead, users are disabled when they are no longer needed.

Within the User Summary page, the following elements are not displayed to Label users or administrators:

Label

Login As

Search Users section

Instead, the Label users/administrators are restricted to seeing only users within their own Label.

In the currently preferred embodiment, 20 users are displayed per page, ordered by Label and name. If there are more than 20 users, previous and next links are displayed for easy access. Clicking an email link takes the user to the User Entry page where he or she can edit information and status for the selected user. Email addresses will not be displayed as links for users who are not allowed to edit other users.

Upon the user clicking the search button, the system returns a list of users whose name or email address contain the search text entered by the user. The list replaces the default list and can be navigated in the same manner if more than 20 entries exist. The clear search button (which is not normally displayed) is now visible. When the button is clicked, the search results are cleared and the default listing is once again displayed (and the clear search button is again hidden).

Clicking the "add new user" link takes the user to the User Entry page where he or she can enter information for a new user. Clicking a "Login as" link logs the user in exactly as if he or she were that specific user. The user will have the same restrictions with regard to capability and the data (that the specific user is restricted to). Any action taken will, however, still be associated with the original user rather than the logged in as user.

User Entry

FIG. 19 is a diagram illustrating the User Entry page. This page is used to add new users and maintain existing ones. When adding a user, all fields are blank and the created and modified date labels and fields are not displayed. When modifying an existing user, the fields contain that user's data. The email address is read-only (i.e., not an input field). The "Add User" button is replaced with an "Update User" button. Fields marked with an asterisk (*) are required.

In the currently preferred embodiment, email address is limited to 80 characters and must conform to the format specified by RFC 822. Email addresses are required to be unique within the system. First name, last name, address lines, and city are limited to 50 characters. State is a drop down and is internally saved as the standard 2-character state abbreviations (see, e.g., www.usps.com). NA is also available for non-US users. Postal code is limited to 15 characters for non-US users. For US users, it must be either 5 digits or 5 digits separated by a dash followed by 4 digits (ZIP+4 format). Country is a drop down and is saved as the standard 2-character country code (see, e.g., www.usps.com).

Phone numbers can include parentheses, dashes, and/or dots. The parentheses, dashes, and dots will be removed when the number is stored, but formatted with parentheses and dashes when displayed leading 1's will be stripped for US phone numbers. Extensions are limited to 5 digits.

User Type will be one of the aforementioned user types: Royalty Share (RS) Administrator; Royalty Share (RS) Account Representative; Label Administrator; or Label User. User types are suppressed for those that the logged in user is not allowed to create.

Label contains all the valid Labels in the system. Labels is not be displayed to Label admins, and will be disabled (but visible) if the user type is one of the Royalty Share (RS) types. Primary and Emergency contacts are required when the user type is Label Admin or User. This field is not displayed to Label administrators, but will default to the same values they have for any Label users they create. Disabled will be a Yes/No dropdown, which defaults to no. Error messages are displayed directly below the input field(s) in error.

Upon the user clicking the "Add" button, the system checks the fields for error. If no problems are found, the user is added and the text "User <email> added" is displayed beneath the add button. Date created is updated and date modified is displayed as blank. The "Add" button changes to the Update User button. The password field is not initially set for new users, and they will therefore be required to establish their password before they can gain access to the system. Upon the user clicking the "Update" button, the system checks the fields for error. If none are found, the user is updated and the text "User <email> updated" is displayed beneath the update button. Date modified is updated.

The rules for user creation may be summarized as follows:

Royalty Share (RS) Administrators can create any type of user.

Royalty Share (RS) Account Representatives can create any type of user except for Royalty Share (RS) Administrators.

Label Administrators can create other Label Administrators and Label Users.

Label Users are not even allowed to be here.

Contact

FIG. 20 is a diagram illustrating the Contact page. The page contains the primary and emergency contact information specified for this user in the User Entry page. Clicking the email links opens a standard mailto: dialog.

Internal Operation

File Type Detection

The system accepts files in a variety of formats, including tab delimited and Excel format. The system examines the file contents to determine type and process accordingly. Currently, however, XML itself has not been adopted by digital service provider to supply data. The format may be supported as soon as it is adopted by providers.

Duplicate File Detection

The system detects when a second attempt is made to upload the same data file and reject the upload immediately. Detection is based on file contents rather than the name of the uploaded file. Number of lines, total units, total revenue, and beginning and ending transaction date suffice for this purpose.

Service Provider Format Detection

The system detects the format of the sales data based on the unique layout for each service provider. If desired, the user interface may also be extended to present a mechanism to select between one of two or more indeterminate formats.

File Processing

The file processing system reads each sales record from the service specific data file and re-formats the data for storage in a standard internal sales format. Validation is performed on each record to ensure that there is a corresponding catalog entry for the specific track or album being processed. Catalog lookups are performed through a mapping layer that connects records with existing fields such as UPC, ISRC, track name (title), or the like (i.e., fields characterizing the media item for the sales record).

Audit Logging

The system internally logs significant events. Every entry includes the user id (identifier) that performed the action, the date and time, the event itself, and any other useful information related to the event. Per the "Login As" feature, the system logs this field if someone is logged in as somebody else (while still logging the true user id).

Figure 21:
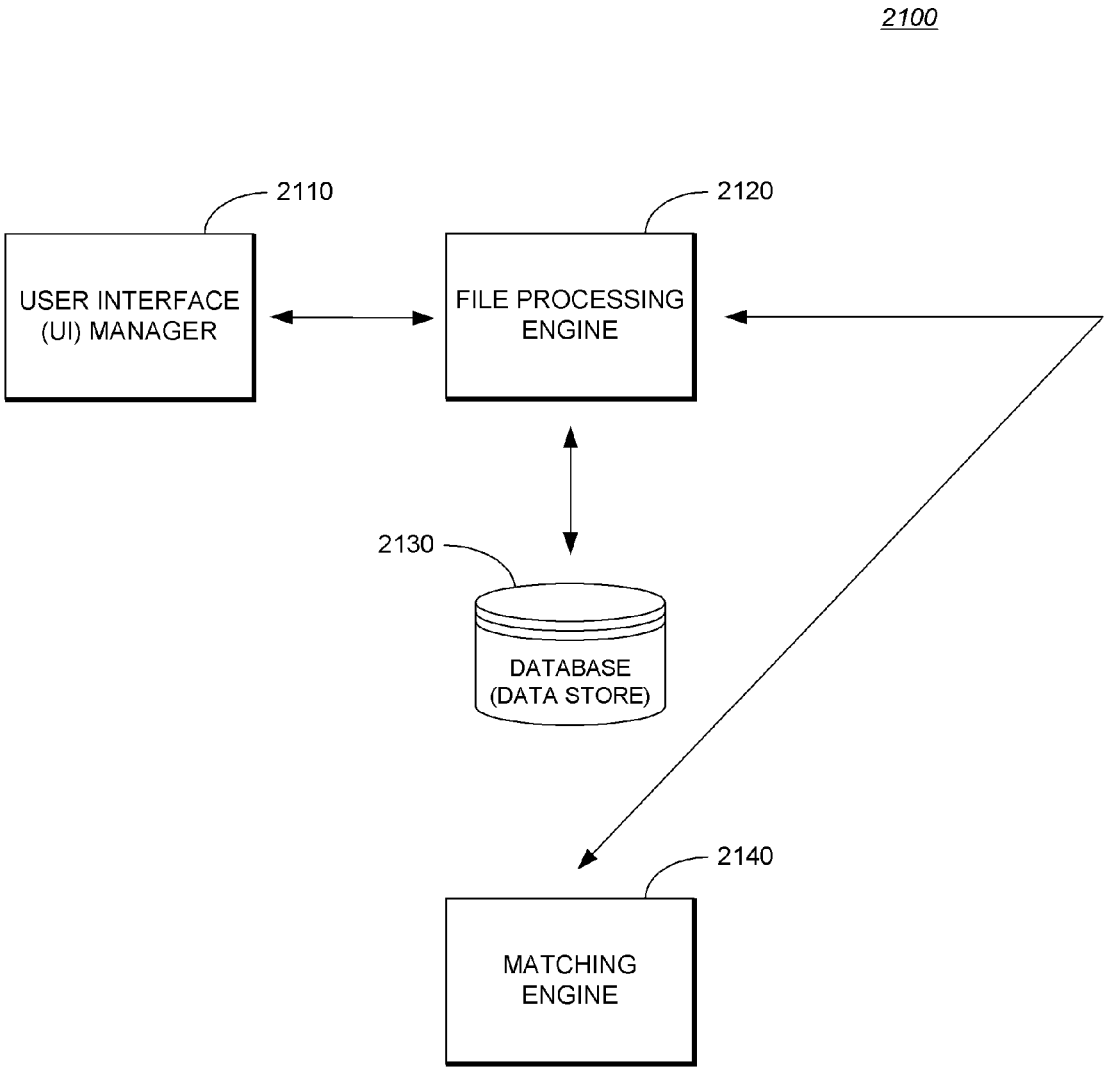
FIG. 21 is a high-level diagram illustrating components that comprise the software architecture of a Web-based Royalty Processing and Reporting System constructed in accordance with the present invention.

Logged events include:

User logged out
User logged in as somebody else
User requested password
User password sent
Record added
Record modified
File uploaded
File downloaded
Report page viewed
File split
Revenue entry
Search performed
Catalog match entered
Period closed Digital Music Service Formats The system also supports specific digital music services, and may accommodate new services as they arise. Currently, the following fields are present in sales files received from music services:

UPC
ISRC (for track sales)
Vendor ID (if available)
Artist
Album
Track (for track sales)
Type (album or track)
Format (download, stream, tethered, etc.)
Units
Price/Extended Price
Sale/Return Flag
Sale Month/Year The following is a list of services supported in the currently preferred embodiment Audio Lunchbox
DownloadPunk
eMusic
itunes
Liquid/Wal-Mart
MSN Music
MusicMatch/Yahoo
MusicNet
MusicNow
Napster
Rhapsody/Real
Sony Connect
Starbucks Source Code Implementation Software Architecture FIG. 21 is a high-level diagram illustrating components that comprise the software architecture of a Web-based Royalty Processing and Reporting System 2100 constructed in accordance with the present invention. As shown, system 2100 comprises a user interface (UI) manager 2110, a file processing engine 2120, a database (data store) 2130, and a matching engine 2140. In typical deployment, the system 2100 is deployed on a Web server, which may be accessed by end users via browser software (e.g., operating on client desktop computers). Each component of the system 2100 will next be described in turn.

The UI manager 2110 is a program module supporting the user interface for the system. Significantly, the user interface provides a browser-based screen display with user input features (e.g., pull down menus, dialog boxes, buttons, and the like) that allow the user to indicate external files containing sales information that may be imported in order to load record data (e.g., line item sales information) into the system, as well as to allow the user to manually input record data (as desired). In typical use, given the potential voluminous size of data, users will elect to import external files instead of manually entering data. The external files themselves may comprise data files in a structured format, such as Excel spreadsheet files, CSV files, comma-delimited files, tab-delimited files, XML files, database files (e.g., Microsoft Access or dBASE files), or the like.

After being imported, external files are passed to the file processing engine 2120, which processes the files so that their data may be represented internally in the system. In the currently preferred embodiment, the system stores each file both in its original version and parsed version. The original version is simply the original copy of the imported file, as it existed on disk. The parsed version, on the other hand, represents database record data (i.e., data records) that has been created based on line item information extracted from the imported file. These data records are now stored in the internal data store or database 2130, as internally-stored structured sales data that can be further processed by the system. The database 2130 is typically implemented using existing third-party relational database software, such as Oracle 9 (available from Oracle Corp. of Redwood Shores, Calif.), Microsoft SQL Server (available from Microsoft Corp. of Redmond, Wash.), or MySQL (available from MySQL AB of Uppsala, Sweden).

After an external file has been imported and its line item information (i.e., individual sales lines) reconstituted into internally-stored data records, the parsed information may be passed to the matching engine 2140, which processes those sales data records against catalog metadata (i.e., known media items). The catalog metadata comprises a database representation of the entire repertoire of a Record Label (e.g., Warner Music, EMI, Apple Records, or the like). Catalog metadata may itself also be stored in the database 2130 (i.e., as database tables separate from imported data). In basic operation, matching is performed by taking the sales data, extracting a subset of fields (e.g., UPC, Album name, Track name, Artist (author) name, and ISRC field) that are relevant for identifying either the Album or Track (including the Album that the Track is associated with), and then processing that subset of information using the matching engine's internal logic to derive a result set comprising imported sales information matched against Record Label metadata. The matching engine uses combinations of raw, clean, scrubbed, and mphon versions of a given sales line item (including recursive versions, such as mphon version of a clean version) for matching to a corresponding track listed in the catalog metadata. Raw is the original format. Clean is an alphanumeric format, that is, with any special characters removed. Scrubbed is a version created by expanding all items out into a normalized alphabetic form, such as expanding "Vol." to "Volume" and "1" to "one". Mphon is a word recognition format, which uses phonetic matching.

Each derived combination of fields from the given sales line item is hashed (e.g., MD5 hash) to create a unique signature or hash key for that particular combination. In a similar manner, for each track that is listed in the catalog metadata, a set of hash keys (considered to be valuable matches) is stored. In the currently preferred embodiment, the hash keys are stored in a separate priority table in the database, with each particular hash key being assigned a weighting (i.e., relevancy). The hash keys are fully cross-referenced to track records stored in the catalog metadata. In this manner, the hash keys that are derived from various combinations of fields (and transformation combinations thereof) can be matched against the priority table to return a result set comprising one product (perfect match) or set of products (closest matches) in the catalog metadata for each given sales line item. After the imported sales data has been processed in the foregoing manner, the match results for the various sales line items may be presented to the user for inspection, editing, and confirmation. For items where a perfect match is not found, for example, the user may optionally select a particular match among a list of "recommendations" (i.e., matches having a weighting of between 70 and 90). Items having a match of 90 or more weighting are by default automatically matched (i.e., do not require user selection). The user is given the option to edit any match results, including editing and deleting matches. After the very final set of matches is reached, the system updates each sales line item record to reflect its specific track identify (i.e., updated to store a product ID reflecting an identified track from the catalog metadata).

Methods of Operation

The following description presents method steps that may be implemented using processor-executable instructions, for directing operation of a device under processor control. The processor-executable instructions may be stored on a computer-readable medium, such as CD, DVD, flash memory, or the like. The processor-executable instructions may also be stored as a set of downloadable processor-executable instructions, for example, for downloading and installation from an Internet location (e.g., Web server).

Figure 22A:
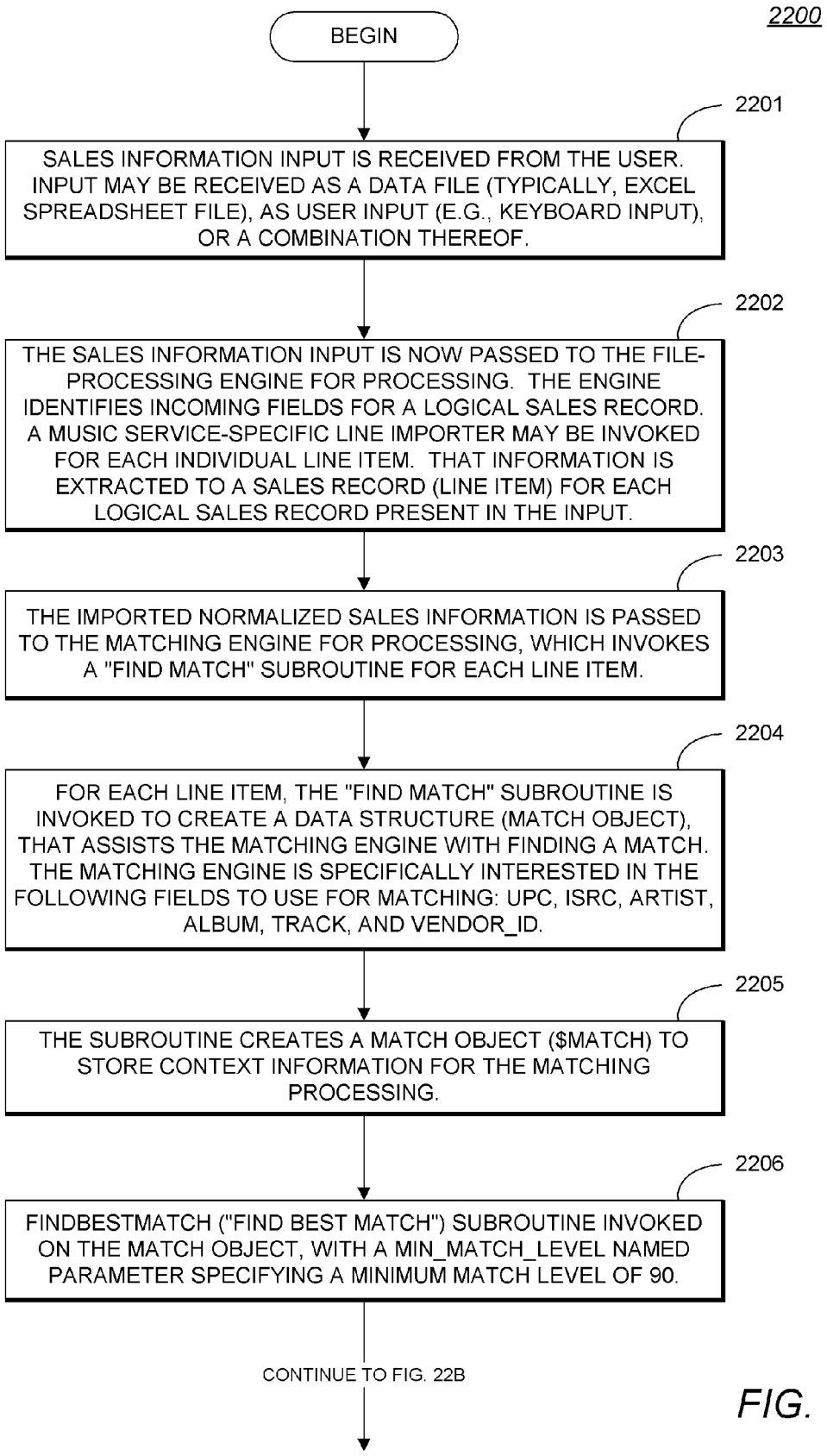
FIGS. 22A-B comprise a high-level flowchart illustrating a method of the present invention for automated royalty processing for media items.
Figure 22B:
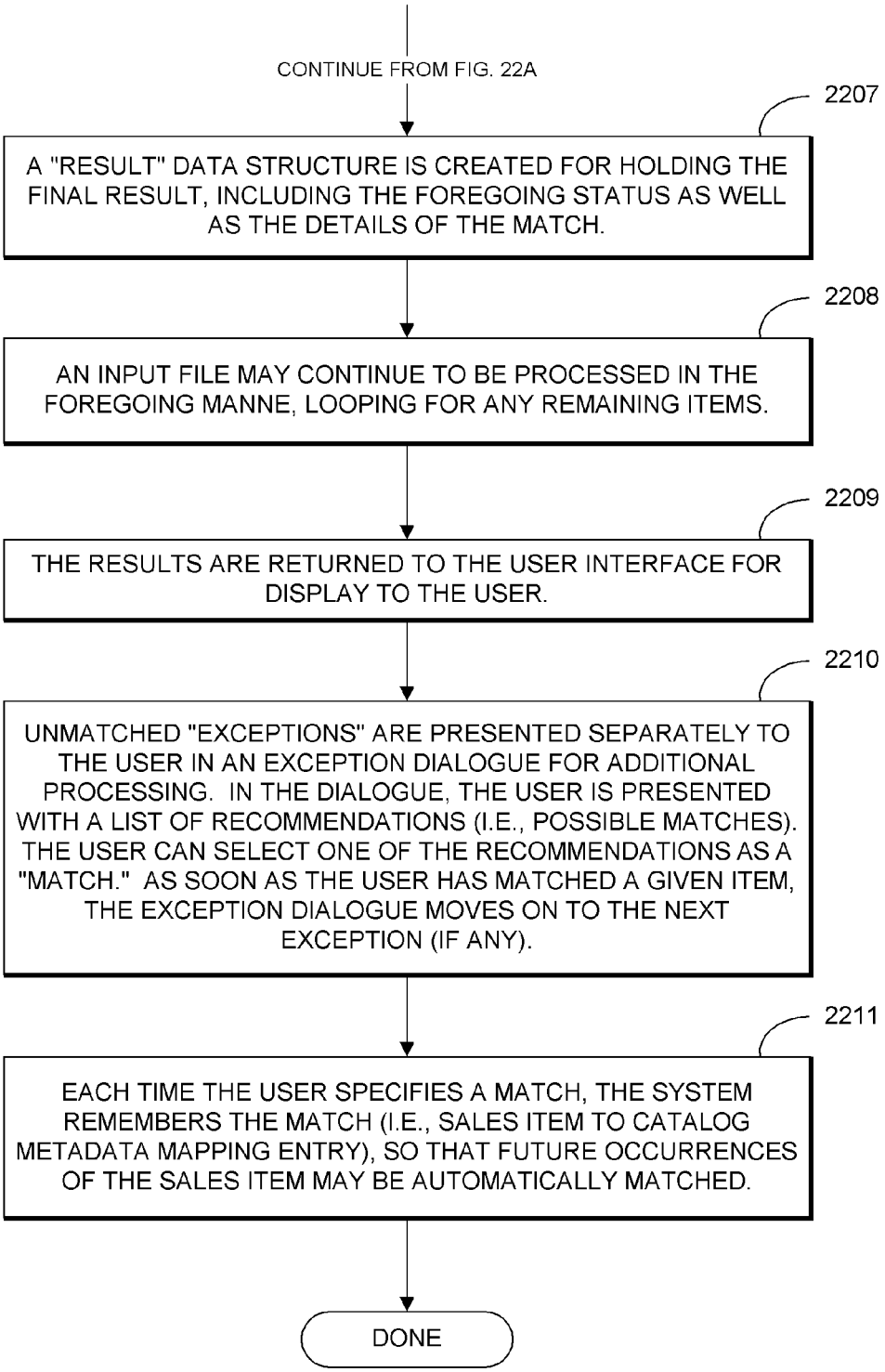

FIGS. 22A-B comprise a high-level flowchart illustrating a method 2200 of the present invention for automated royalty processing for media items. To begin operation, sales information input is received from the user, at step 2201. As previously described, this input may be received as a data file (typically, Excel spreadsheet file), as user input (e.g., keyboard input), or a combination thereof. The sales information input is now passed to the file-processing engine for processing, at step 2202. Here, the engine identifies incoming fields for a logical sales record. That information is extracted to a sales record (line item) for each logical sales record present in the input. In the currently preferred embodiment, each sales record may be stored in the internal database using the following normalized format (represented as a record or "struct" data structure in PERL source code):

```
1: struct SaleRec =>
2: {
3:    serviceID     => '$',
4:    importStatus    => '$',
5:    productType     => '$',
6:    formatType        => '$',
7:    dateBegin     => '$',
8:    dateEnd        => '$',
9:    serviceProductID => '$',
10:    clientProductID    => '$',
11:    upc        => '$'
12:    isrc       => '$',
13:    artistName     => '$',
14:    albumName     => '$',
15:    trackName     => '$',
16:    labelName     => '$',
17:    trackNum     => '$',
18:    units        => '$',
19:    price        => '$',
20:    currencyCode    => '$',
21:    conversionRate    => '$',
22:    countryCode     => '$',
23:    priceLevel     => '$',
24:    channel        => '$',
25:    returns        => '$',
26:    priceReturns     => '$',
27:    discount        => '$',
28:    outlet        => '$',
29:    configuration    => '$',
30:    lineNum        => '$',
31:    free        => '$'
32: };
```

The above structure embodies all of the field information captured from the imported (or user-entered) sales information. Of particular interest to matching (described in further detail below) are code lines 11-15. These lines comprise the fields that are used for matching in the currently preferred embodiment:

upc: Uniform Product Code isrc: International Standard Recording Code (individual track identifier)

artistName: artist name albumName: album name trackName: track name

The process of capturing values (i.e., filling out SalesRec record data) from imported files falls to an Import class or module, which includes an Import subroutine directing the overall importation of individual lines of input (e.g., individual lines of text from an imported file). The subroutine may be implemented as follows:

```
1: sub Import
2: {
3:    my $self = shift;
4:    my %args = @_;
5:    my $fileObj = $args{file};
6:    my $retval = undef;
7:    my $clientID = $args{client_id};
8:    my $fileID = $fileObj->FileID;
9:     return undef unless ($clientID && $fileID);
```

-continued

```
10:    $self->{dbo} = new Common::RSDB(client_id => $clientID);
11:    $self->{clientID} = $clientID;
12:    $self->{fileID} = $fileID;
13:    # Use a hash to keep track of all the services we see.
14:    $self->{services} = { };
15:    $self->{services}{$fileObj->ServiceID} = 1;
16:    $retval = $self->_importLines(%args);
17:    $self->_postProcess(%args) if $retval;
18:   return $retval;
19: }
```

At the point that the Import subroutine is invoked, the imported file is presented as a logical file object ($fileObj). The file object is an internal representation of the imported file, typically structured in memory as an array of arrays. For an imported text file, there is a single array representing each line of text from the actual text file. For more complex imported files (e.g., Excel spreadsheet file), multiple arrays are employed for representing the additional information present. After the imported file is normalized into a logical file object, subsequently invoked subroutines (e.g., Import subroutine) may simply process the logical file object as a normalized file (i.e., without concern for whether the originally imported file was a text file, Excel spreadsheet file, XML file, or the like). Now, a music service-specific line importer may be invoked for each individual line item. As shown by source code line 16 above, the file object is passed as an argument or parameter to an import lines (_importLines) subroutine. In particular, this invokes a specific subclassed line importer that has been instantiated based on a particular music service (e.g., MusicNet, Napster, and the like) being targeted for the import. Each music service is associated with its own subclassed Import that serves as a music service-specific importer. FIGS. 23A-E illustrate source code embodiment for a subclassed importer that is associated with the MusicNet music service. As shown, this subclass inherits from the Import (parent) class and adds specific features/processing that pertain to the MusicNet music service. After importation of the incoming data (i.e., after step 2202) by a music service-specific importer (i.e., subclassed Import), the imported sales information is now available in a normalized internal format that may be further processed by the system.

Now, the imported normalized sales information is passed to the matching engine for processing, at step 2203. At this point, the work of performing the actual matching is done by the base (parent) Import class. Specifically, the Import class includes a _findMatch ("find match") subroutine, which may be implemented as follows:

```
1: sub __findMatch
2: {
3:    my $self = shift;
4:    my %args = @_;
5:    my $saleDB = $args{sale};
6:    my $data =
7:    {
8:      product_type => $saleDB->ProductType,
9:      client_product_id => $saleDB->ClientProductID,
10:       upc => $saleDB->UPC,
11:       isrc => $saleDB->ISRC,
12:       artist => $saleDB->ArtistName,
13:       album => $saleDB->AlbumName,
14:       track => $saleDB->TrackName,
15:       vendor_id => $saleDB->ServiceProductID,
16:    };
17:    my $match = Sale::Match->new(client_id => $self->{clientID});
18:    my $result = $match->FindBestMatch(data => $data, min_match_level
=> 90, skip_rec => 1);
19:    $saleDB->ImportStatus($result->ImportStatus);
20:    if ($saleDB->ImportStatus == File::Sale::STATUS_MATCH)
21:    {
22:      $saleDB->ProductID($result->ProductIDs->[0]);
23:    }
24:    elsif ($saleDB->ImportStatus == File::Sale::STATUS_MAPPED)
25:    {
26:      $saleDB->ProductID($result->ProductIDs->[0]);
27:      $saleDB->MapID($result->MapID)
28:    }
29:    elsif ($saleDB->ImportStatus == File::Sale::STATUS_AUTO_MAPPED)
30:    {
31:      $saleDB->ProductID($result->ProductIDs->[0]);
32:      $saleDB->MapID($result->MapID)
33:    }
34:    elsif ($saleDB->ImportStatus == File::Sale::STATUS_BATCH_MAPPED)
35:    {
36:      $saleDB->ProductID($result->ProductIDs->[0]);
37:      $saleDB->MapID($result->MapID)
38:    }
39: }
```

At step 2204, the above subroutine is invoked to create a data structure ($data), at source code lines 6-16, that assists the matching engine with finding a match. As shown, the matching engine is specifically interested in the following fields to use for matching: upc, isrc, artist, album, track, and vendor_id. The product_type and client_product_id are also passed in to the subroutine. Some music services will (infrequently) import sales information with a product ID that either the service provided or the Record Label provided. Therefore, in those instances the matching engine may at the outset attempt to match on product ID. A potential match on product ID can be verified using a secondary match on upc (for album-based product) and/or isrc (for track-based product). The product_type field is not used for matching per se but instead indicates whether the item to be matched is a track sale or album sale. At step 2205, the subroutine creates a match object ($match, at source code line 17) to store context information for the matching processing. Now, at step 2206, a FindBestMatch ("find best match") subroutine may be invoked on the match object, as shown at source code line 18. As shown, the subroutine is invoked with a min_match_level named parameter specifying a minimum match level of 90; additionally, a skip_rec named parameter is passed indicating that the FindBestMatch subroutine should not make any recommendations.

FIGS. 24A-G illustrate source code embodiment for the FindBestMatch subroutine. After initialization, the subroutine at source code line 6 checks to see if there is a previous map entry for the input (sales item) data. If so, then the subroutine can short-circuit the normal search. Once the system has matched a product (and received user confirmation of the match), the system keeps a record of that match. The source code at line 6 checks for the existence of such a match, and will short-circuit the matching process when a prior match has already been established. If a prior match does not exist, then the subroutine proceeds to perform a series of lookup match tests, at source code lines 10-19. These are essentially quick lookup operations, based on client/vendor product ID or alternative UPC (e.g., that may have been provided by the music service). Source code lines 21-26 set the minimum match level. If one is already established (e.g., passed as a named parameter), then that is used. Otherwise, the subroutine sets a default minimum match level of 90, and a default minimum recommendation level of 70. In a similar manner, the default for skipping regular expression searching is set at source code lines 25-26, and default for skipping recommendations is set at source code lines 27-29.

At source code line 30, the subroutine retrieves the various match patterns (i.e., the different permutations of match fields previously described). In the currently preferred embodiment, the maximum number of permutations employed is limited to a preselected limit (e.g., 550). The match string of line 30 contains all of the various permutations joined together as an MD5 list that may be passed to the database as part of a SQL query. Note that the MD5 list eliminates duplicates (e.g., permutations that resolve to the same normalized form and hence same MD5 signature). The list of MD5 signatures is used to query against corresponding MD5 signatures in the metadata catalog table (i.e., query against metadata from product pattern matches); the SQL query (string) itself is set at lines 32-37. From executing the query, the subroutine determines a matching product_id, pattern (e.g., natural version, clean version, etc.), and level (i.e., level for that pattern).

At source code lines 42-62, a "while" loop is established to look at whether the match was exact (native) or fuzzy (alternative, non-native). Based on the type determined, the match is added to a particular list (e.g., list of exact matches), at source code lines 65-71. If any exact matches exist, then that becomes the list of products, otherwise any fuzzy matches becomes the list of products, and so forth and so on. Alternatively, if no appropriate match exists, the subroutine may proceed to attempt matching via regular expression comparisons, beginning at line 72. Ultimately, the subroutine will generate a list, at line 148, based on matching product (if any).

Beginning at source code line 150, the subroutine addresses the scenario of no matching product (i.e., the list is empty). If recommendations are sought (i.e., the skip_rec flag is not set), the subroutine will perform additional searching for items that may be suitable for recommendations (i.e., interactive search recommendations), even though they may not be suitable for automatic matches. To this end, the subroutine constructs additional queries via a series of "if else" statements, spanning from line 158 to line 310. For example, at source code line 161, the subroutine constructs a query based only on the artist, album, and track—that is, attempting to construct a match based on a smaller subset of fields. If that does not work, then at source code line 180 the subroutine can narrow the search down to just artist and album. At source code line 195, the subroutine simply attempts to match by track. Other combinations may be attempted (as illustrated by the source code). If a match is still not found, then the subroutine may construct additional queries based on substrings, such as an artist's last name (e.g., rightmost substring), a portion of the track, a portion of the album, or the like. After these brute force string-matching techniques have been applied to exhaust possible searches, the subroutine reaches line 311. Here, the subroutine sets up a status flag storing the value of STATUS_MATCH, STATUS_NOMATCH, or STATUS_MULTIMATCH, indicating the outcome of the matching operation. A "result" data structure is created for holding the final result, including the foregoing status as well as the details of the match, as indicated by step 2207. This result is returned at source code line 331, whereupon the subroutine concludes.

An input file may continue to be processed in the foregoing manner—that is, looping for any remaining items as shown by step 2208. The results are returned to the user interface for display to the user at step 2209. In the currently preferred embodiment, the user interface indicates how many line items are present in a given imported file, together with an indication of how many of those items were automatically matched to sales. Items that are not matched to sales are shown as "exceptions," which can be presented separately to the user in an exception dialogue for additional processing. In the dialogue, the user is presented with a list of recommendations (i.e., possible matches), at step 2210. The user can select one of the recommendations as a "match." Alternatively, should the user find the recommendations unsatisfactory, he or she can perform additional searches against the catalog metadata (e.g., by entering search strings) for locating a better match. As soon as the user has matched a given item, the exception dialogue moves on to the next exception (if any), whereupon the user can repeat the foregoing user interface operation. Each time the user specifies a match, the system remembers the match (i.e., memorizes the sales item to catalog metadata mapping entry) at step 2211, so that future occurrences of the sales item may be automatically matched. After identification of the media items, the matched information may be further processed as previously described (e.g., for reporting, royalty obligation computations, and the like).

Appended herewith are program listings of Perl source code that provide further description of the present invention. The listings demonstrate source code implementation supporting the above-described user interface, for implementing an easy-to-use, Web-based royalty processing and reporting service for content providers and the entertainment industry. A suitable development environment for compiling the code is available from a variety of sources, including Open Perl IDE available via the Internet (currently at open-perl-ide.sourceforge.net). The program listings present method steps that may be implemented using processor-executable instructions, for directing operation of a device under processor control.

While the invention is described in some detail with specific reference to a single-preferred embodiment and certain alternatives, there is no intent to limit the invention to that particular embodiment or those specific alternatives. For instance, those skilled in the art will appreciate that modifications may be made to the preferred embodiment without departing from the teachings of the present invention.

What is claimed is:

1. A method implemented in a computer having a processor and a memory for automatically correlating sales records to specific media items subject to royalty obligations, the method comprising:

storing catalog metadata comprising a database representation of media items unique to a given record label's repertoire, said catalog metadata storing for each given media item a set of signatures based on different combinations of information about the given media item;

receiving from a user sales records that document purchases that have occurred for media items subject to royalty obligations, at least some of the sales records requiring additional processing in order to determine applicable royalty obligations, at least some sales records missing information about which specific media item has been purchased;

parsing the sales records to extract from each sales record a set of fields having at least some information about a given media item purchased;

deriving a set of signatures for each sales record, based on different combinations of the fields extracted for that sales record;

comparing the set of derived signatures for each sales record against corresponding sets of signatures stored in said catalog metadata;

based on the comparison, automatically correlating each sales record to one specific media item that is subject to royalty obligations; and reporting the correlated sales records to the user.

2. The method of claim 1, wherein said media items comprise digital media items.

3. The method of claim 1, wherein said media items include digital music.

4. The method of claim 3, wherein said digital music includes downloadable music files.

5. The method of claim 1, wherein said media items include digital video.

6. The method of claim 5, wherein said digital video includes downloadable video files.

7. The method of claim 5, wherein said digital video includes movies.

8. The method of claim 5, wherein said digital video includes television programs.

9. The method of claim 1, wherein said sales records comprise an imported file.

10. The method of claim 9, wherein said imported file is provided with a format of a spreadsheet file, an XML file, and/or a database file.

11. The method of claim 1, wherein said database stores a database representation of media items owned by at least one particular owner.

12. The method of claim 1, wherein said media items include digital music and said database stores a database representation of digital music owned by at least one particular Record Label.

13. The method of claim 1, wherein said media items include electronic books.

14. The method of claim 1, wherein said parsing step includes:

extracting a title for each media item.

15. The method of claim 1, wherein said parsing step includes:

extracting an author for each media item.

16. The method of claim 1, wherein said media items include digital music, and wherein said parsing step includes: extracting for each media item a subset of fields comprising at least one of: UPC (Universal Product Code), Album name, Track name, Artist name, and/or ISRC (International Standard Recording Code).

17. The method of claim 1, further comprising:

displaying a dialog allowing the user to modify how media items are identified.

18. The method of claim 1, further comprising:

displaying royalty obligation information for each identified media item.

19. The method of claim 1, wherein each of said each set of signatures comprises a hash key.

20. The method of claim 19, wherein said hash key comprises an MD5 message digest of a particular combination of fields for a given media item.

21. The method of claim 1, wherein each signature of said each set of signatures is assigned a weighting for indicating relevancy of the combination of fields that the signature is based on.

22. The method of claim 21, wherein signatures having a weighting above a preselected value are used for automatic matching without further input from the user.

23. The method of claim 22, wherein signatures having a weighting below said preselected value are used for creating recommendations that are presented to the user when a best match cannot be automatically identified.

24. The method of claim 1, further comprising:

receiving confirmation from the user that a given media item has been correctly identified; and memorizing how the given media item was identified, so that future occurrences of the given media item may be correctly identified.

25. A system for automatically correlating sales records to specific media items subject to royalty obligations, the system comprising:

a computer having a processor and a memory, the memory storing instructions that when executed by the processor cause the processor to perform a method, the method comprising:

storing catalog metadata comprising a database representation of media items unique to a given record label's repertoire, said catalog metadata storing for each given media item a set of signatures based on different combinations of information about the given media item;

receiving from a user sales records that document purchases that have occurred for media items subject to royalty obligations, at least some of the sales records requiring additional processing in order to determine applicable royalty obligations, at least some sales records missing information about which specific media item has been purchased;

parsing the sales records to extract from each sales record a set of fields having at least some information about a given media item purchased;

deriving a set of signatures for each sales record, based on different combinations of the fields extracted for that sales record;

comparing the set of derived signatures for each sales record against corresponding sets of signatures stored in said catalog metadata;

automatically correlating, based on the comparison, each sales record to one specific media item that is subject to royalty obligations; and reporting the correlated sales records to the user.

26. The system of claim 25, wherein said media items comprise digital media items.

27. The system of claim 25, wherein said media items include digital music.

28. The system of claim 27, wherein said digital music includes downloadable music files.

29. The system of claim 25, wherein said media items include digital video.

30. The system of claim 29, wherein said digital video includes downloadable video files.

31. The system of claim 29, wherein said digital video includes movies.

32. The system of claim 29, wherein said digital video includes television programs.

33. The system of claim 25, wherein said sales records comprise an imported file.

34. The system of claim 33, wherein said imported file is provided with a format of a spreadsheet file, an XML file, and/or a database file.

35. The system of claim 25, wherein said database stores a database representation of media items owned by at least one particular owner.

36. The system of claim 25, wherein said media items include digital music and said database stores a database representation of digital music owned by at least one particular Record Label.

37. The system of claim 25, wherein said media items include electronic books.

38. The system of claim 25, wherein the parsing includes extracting a title for each media item.

39. The system of claim 25, wherein the parsing includes extracting an author for each media item.

40. The system of claim 25, wherein said media items include digital music, and wherein the parsing includes extracting for each media item a subset of fields comprising at least one of: UPC (Universal Product Code), Album name, Track name, Artist name, and/or ISRC (International Standard Recording Code).

41. The system of claim 25, wherein said method further comprises displaying a dialog allowing the user to modify how media items are identified.

42. The system of claim 25, wherein said method further comprises displaying royalty obligation information for each identified media item.

43. The system of claim 25, wherein each of said each set of signatures comprises a hash key.

44. The system of claim 43, wherein said hash key comprises an MD5 message digest of a particular combination of fields for a given media item.

45. The system of claim 25, wherein each signature of said each set of signatures is assigned a weighting for indicating relevancy of the combination of fields that the signature is based on.

46. The system of claim 45, wherein signatures having a weighting above a preselected value are used for automatic matching without further input from the user.

47. The system of claim 46, wherein signatures having a weighting below said preselected value are used for creating recommendations that are presented to the user when a best match cannot be automatically identified.

48. The system of claim 25, wherein said method further comprises:

receiving confirmation from the user that a given media item has been correctly identified; and memorizing how the given media item was identified, so that future occurrences of the given media item may be correctly identified.

49. The system of claim 25, wherein the system is implemented at least in part as a Web-based system having a user interface that presents information to users via a Web browser.

50. The system of claim 25, wherein said different combinations of information include normalized versions of that information.

51. The system of claim 50, wherein said information is normalized by expanding abbreviations.

52. The system of claim 50, wherein said information is normalized by removing non-alphanumeric characters.

* * * * *